US007131604B2

(12) United States Patent
Enomura

(10) Patent No.: US 7,131,604 B2
(45) Date of Patent: Nov. 7, 2006

(54) PROCESSING APPARATUS AND METHOD FOR FLUID, AND DEAERATOR THEREWITH

(75) Inventor: Masakazu Enomura, Osaka (JP)

(73) Assignee: M. Technique Company, Ltd., Osaka (JP)

( * ) Notice: Subject to any disclaimer, the term of this patent is extended or adjusted under 35 U.S.C. 154(b) by 49 days.

(21) Appl. No.: 10/619,479

(22) Filed: Jul. 16, 2003

(65) Prior Publication Data

US 2004/0032792 A1 Feb. 19, 2004

(30) Foreign Application Priority Data

Jul. 16, 2002 (JP) ..... 2002-207533
Nov. 5, 2002 (JP) ..... 2002-321018
Nov. 25, 2002 (JP) ..... 2002-340374

(51) Int. Cl.
*B05B 1/26* (2006.01)
*B05B 1/34* (2006.01)
*B05B 1/14* (2006.01)

(52) U.S. Cl. ..... 239/461; 239/464; 239/479; 239/484; 239/650; 239/687; 239/680; 239/469; 241/257.1; 241/38; 241/251; 241/67; 241/73; 241/84; 241/184

(58) Field of Classification Search ..... 239/461, 239/464, 469, 479, 484; 241/38, 251, 67, 241/73, 84, 184
See application file for complete search history.

(56) References Cited

U.S. PATENT DOCUMENTS 1,719,784 A 7/1929 Ross
2,751,157 A * 6/1956 Meyer et al. ..... 241/38
3,817,461 A * 6/1974 Geissel et al. ..... 241/73
4,082,233 A * 4/1978 Reinhall ..... 241/244
4,820,381 A 4/1989 Brown (Continued)

FOREIGN PATENT DOCUMENTS

BE 424 712 1/1938

(Continued)

OTHER PUBLICATIONS

Japanese Patent Abstract No. 07-185372, Masuda, High Speed Pulverizing Method and Device Thereof, Jul. 25, 1995, Japanese App. No. 05-348616, all.*

*Primary Examiner*—David A. Scherbel
*Assistant Examiner*—James S. Hogan
(74) *Attorney, Agent, or Firm*—Birch, Stewart, Kolasch & Birch, LLP

(57) ABSTRACT

A processing apparatus for fluid with a simple structure, high productivity, ability of precise dispersion, emulsification and grinding, is provided.

The apparatus of the present invention comprises at least two processing faces of a first face and a second face, both of which are arranged in a tight-closed passage, and positioned opposite to each other to constitute part of said passage, and a contact pressure applying mechanism for putting both faces 1, 2 into closed contact with each other, wherein the rotation of the second processing face 2 in respect of the first processing face 1 may cause dispersion or emulsification of the fluid to be processed between both processing faces 1, 2. The first and second processing faces 1, 2 are placed in closed contact with or adjacent to each other by means of said contact pressure applying mechanism, and the fluid to be processed is actuated by said rotation to pass between the first and second processing faces 1, 2, as it is forming fluid films between said processing faces 1, 2, so that said fluid will be emulsified or dispersed to a desired extent.

20 Claims, 18 Drawing Sheets

U.S. PATENT DOCUMENTS

| | | | | | |
|---|---|---|---|---|---|
| 5,200,038 | A | * | 4/1993 | Brown | 162/261 |
| 5,622,650 | A | * | 4/1997 | Rourke | 516/9 |

FOREIGN PATENT DOCUMENTS

| | | | | |
|---|---|---|---|---|
| DE | 639 769 | | | 12/1936 |
| DE | 763 303 | C | | 6/1953 |
| DE | 37 40 975 | A1 | | 6/1989 |
| EP | 256147 | A1 | * | 2/1988 |
| JP | 56-31451 | A | | 3/1981 |
| JP | 58-39159 | | | 9/1983 |
| JP | 655304 | S | | 7/1985 |
| JP | 61-91337 | | | 6/1986 |
| JP | 61-159375 | B2 | | 7/1986 |
| JP | 62-51658 | B2 | | 10/1987 |
| JP | 3-1061 | B2 | | 1/1991 |
| JP | 845632 | | * | 8/1992 |
| JP | 845632 | S | | 8/1992 |
| JP | 7-185372 | A | | 7/1995 |
| JP | 8-1020 | A | | 1/1996 |
| JP | 8-500524 | A | | 1/1996 |
| JP | 9-299817 | A | | 11/1997 |
| JP | 2002-207533 | | | 7/2002 |
| RU | 1708397 | A | * | 1/1992 |
| SU | 1708397 | A1 | | 1/1992 |

* cited by examiner

PROCESSING APPARATUS AND METHOD FOR FLUID, AND DEAERATOR THEREWITH

This nonprovisional application claims priority under 35 U.S.C. § 119 (a) on Patent Application No(s). 2002-207533, 2002-321018, and 2002-340374 filed in JAPAN on Jul. 16, 2002, Nov. 5, 2002, and Nov. 25, 2002, which is(are) herein incorporated by reference.

FIELD OF THE INVENTION

The present invention relates to a processing apparatus and method for fluid, and a deaerator with the apparatus.

BACKGROUND OF THE INVENTION

To begin with, description is made of the conventional art for the processed of dispersion and emulsification.

There have been widely used dispersing systems generally called "media mill" in the producing systems for coating medium, inks, magnetic materials, ceramics, cells, adhesives, electronic materials, liquid crystal color filters, medicines, cosmetics, perfumes, foods, etc. This specific dispersing system is intended to obtain desired dispersion of fluid being processed by agitating said fluid being processed in the dispersion chamber filled with beads, sand, or balls, as called media, to apply a shear force, and impact to said fluid for dispersion.

As a first disadvantage consisting in this system, during process, friction between media, between the media and the agitating blades of the apparatus, between the media and the inner side of a container may bring about some chips ground from said matters so that said chips will be mixed into said fluid as impurity. As a result, frequent supplement of loss due to friction with fresh media and exchange of parts are needed, thus entailing extra troubles and cost accordingly.

A second disadvantage is that application of a stronger shear force or demand of smaller particle diameter requires the use of media of smaller diameter than those in the past, for example, use is often made of fine media in the size of 0.05 or 0.1 millimeter in diameter, and there is a tendency to seek for media of relatively small diameter. However, the smaller the diameter of media, the smaller the mass of each medium, which may cause decrease of the dispersible range of viscosity of the fluid to be processed with the consequence that only a substance of low viscosity is applicable.

Meanwhile, a roll mill and a colloid mill are known except for said media mill.

The colloid mill acts to give a shear force to the fluid to be processed by passing said fluid through the interval formed between two disks laid one upon another. In this case, the width of the interval can be determined mechanically by means of an adjusting handle, but the apparatus used is only capable of adjusting on the level of substantially more than several dozen microns (no adjustment was possible as to the level of less than 10 microns). Further reduction of the width may incur the risk of a serious accident on account of the contacts of the disks as occurred by thermal expansion or run-out of the rotary shaft.

The roll mill acts to apply a shear force to said fluid by rotating two or three rolls at different speeds and in different directions, respectively. The width of the interval between said rolls may be regulated mechanically. Also in this event, as in the case of the colloid mill, it is hard to adjust the width at the level of scores of micron. And it is necessary to provide adequate crowns for further regulation of the pressure occurring between the rolls, which operation needs human skills and involves risks of accidents. Moreover, the apparatus itself remains so opened that it is not useful for fluid containing rather evaporable solvent. As both the colloid mill and the roll mill are dependent on stronger intervals for efficient application of a shear force to fluid to be processed, which should be of a high viscosity.

Furthermore, a high-speed rotary homogenizer and a high-pressure homogenizer are also known. The former is employed as a pre-dispersing unit, but it is unavailable for precise dispersion. The latter is known that when used as industrial equipment it, it is endowed with too many difficulties such as wear and tear of the orifice portion or stopping of capillary as well as seal wear of the booster pump.

In this connection has been sought for the development of a dispersing apparatus arranged such that inclusion of impurity can be avoided, a stronge shear force can be given to fluid having a wider application range of viscosity, and dispersion, emulsification and crushing can be performed at a high precision.

Next, the conventional art for attrition and pulverization will be described.

Conventional pulverizers based on hand mill principles include a pair of whetstones that are laid one upon another and adjustable in the interval therebetween, wherein a strong centrifugal force, an impact grinding force and shear are produced between said whetstones, thus a combined action of them performs attrition and pulverization. The attrition or pulverizing apparatuss provided with rotatable and/or stationary whetstones are disclosed by the following official gazette.

Patent document 1: Japanese (JP) design registration No.655304

Patent document 2: JP design registration No. 845632

Patent document 3: JP examined patent application publication No. S62-51658

Patent document 4: JP examined patent application publication No. H03-1061

Patent document 5: JP examined patent application publication No. H04-55830

A rotary or stationary whetstone used here is generally called grinders, commonly having particle sizes 16#, 24# to 120#, and 240#. Though having different particle sizes, these grinders are uneven on the surface, and when they handle hard a substance to be processed, there is possibility that raised portion will be scraped or worn out to cause inclusion of impurity.

It has been reported that the grinding apparatus as disclosed in the following patent document 6 is capable of grinding a material into fine particles of the order of 1 to 5 microns, but it is unable to obtain fine particles of under 1 micron with said apparatus.

Patent document 6: JP examined patent application publication No. S62-51658

There is a report relating to the grinding system as disclosed by the following patent document 7. According to the report, in pulverization of a substance to be processed that contains high fat, much moisture, high protein, sugar, and specific enzymes, such particular properties tend to change because of stickiness, scorching, or transformation into film due to frictional heating, so that said substance are not marketable as in the form of powder. And if the peripheral velocity of the rotary whetstone has risen above a certain level, grinding ability thereof is rapidly increased, concurrently with the temperature rise due to frictional heat decreasing its degree, and when the peripheral velocity of 3,422 meters per minute has reached, problems in machine cost and mechanical security occur.

Patent document 7: JP laid-open patent Application No. H07-185372

Furthermore, the following patent document 8 discloses an automated controlling method for the clearance between the rotary and stationary whetstones. In this particular method, mechanical heat build-up occurs from the high-speed rotation, but in the absence of a buffer system for thermal expansion of the driving shaft and for run-out of the rotary whetstone, the minimum clearance is liable to widen over dozens of microns.

Patent document 8: JP laid-open patent application No. H08-1020

The following patent document 9 discloses the invention useful for grinding, dispersion and emulsification of fluid to be processed, in particular liquid. However, a fluid pressure applying mechanism for fluid and a head pressure are needed for processing the fluid.

Patent document 9: JP patent application No. 2002-207533

After all, in the event of supplying a material to be processed under the atmospheric pressure, each of the aforementioned systems are incapable of narrowing the clearance between the two whetstones (grinding members) laid one upon another to less than 15 microns. Namely, the foregoing clearance between the whetstones by means of the conventional mechanical means can not be suitable for micro-scale attrition or grinding. Meanwhile, the use of said mills for attrition and grinding operations may cause inclusion of foreign substances (chips resulting from the contact between the mills or the mill and other matters), and a grinding apparatus which may safely rotate at high speed for high performance is not available.

Here, description will be made of a conventional art for deaerating process.

Deaerators for a substance to be processed involve, for example, a unit that serves to remove bubbles from liquid.

This bubble removing unit comprises an external cylindrical rotor disposed within a vacuum vessel, an internal cylindrical rotor arranged in concentric alignment with the external rotor in the interior of said external rotor, and a hollow shaft driven for revolution by motor, the internal rotor being connected with said shaft and rotating in respect of the external rotor.

The peripheral face of said internal cylindrical rotor may be composed of a punching plate. The peripheral face of said external cylindrical rotor may be constituted of a screen of finer surface texture than that of said punching plate.

Next, the action of this bubble removing unit will be explained.

Said shaft has a passage for liquid to be processed thereinside. Said liquid travels through the shaft into the internal rotor. By the passage of liquid through the shaft rotating at high speed, the liquid phase is centrifuged toward the inner wall of the shaft, and bubbles toward the center of the shaft. At this time, prior to the liquid phase, the bubbles are drawn toward the center of the shaft, expanding before deaerated.

In said liquid phase as introduced into the internal rotor after said motion of the bubbles, the centrifugal force caused by the rotary motion effects film formation, which may forward the removal of bubbles. Then, the liquid phase passes through the punching plate of the internal rotor until it has been subjected to atomization, which may promote deaeration. Having passed through the punching plate, the liquid gets in contact with the external rotor, and passes through the screen. Then, the liquid is scattered in a spray within the vacuum, hitting the inner wall of the vessel to fall down along the inner wall before the termination of the removal of bubbles.

This particular bubble removing unit may chiefly perform atomization of substance by allowing the substance to pass through said punching plate and screen. Such atomization acts to promote emission of bubbles contained in the substance, and said unit may achieve smooth deaeration by the use of such action.

The size of bubbles resulting from the atomization is highly dependent on the fine texture of the punching plate and screen.

The fine division of the textures of the punching plate and screen has a physical limit, so that they are not useful for removal of bubbles much finer than the textures of the punching plate and screen. That is, with the bubble removing unit of the described construction, 10 to 20 microns is the limit of fine division, therefore, super fine division into 1 to 2 microns was impossible.

If a substance to be processed was emulsion or suspension, it was necessary to deaerate by means of said bubble removing unit the substance which had been emulsified or suspended, for example, through a high-speed agitating or dispersing unit in advance.

As the textures of the punching plate and screen are so smudged by the previous process operation that they may clog up, prior to use of said bubble removing unit for the next operation, the punching plate and screen must be cleaned sufficiently.

Said punching plate and screen cause nuisance of cleaning and removing of clogs thereof.

The present invention has been made based on said status of dispersion and emulsification processes, which invention may provide a dispersion and emulsification apparatus of a simple structure and high productivity, which is capable of making dispersion, emulsification, and shattering with high precision, on the basis of a unique idea of making use of the mechanical seal mechanism as means of dispersion and emulsification for solution of the foregoing problems.

That is, the object of the present invention is to provide a dispersion and emulsification apparatus which may prevent inclusion of impurity, and make highly precise dispersion, emulsification, and shattering.

In particular, the further object of the present invention is to provide a dispersion and emulsification apparatus which can set a predetermined width at the interval of the clearance between two processing faces relatively rotatable to each other, and furnish fluid to be processed with a strong shear force.

Another object of the present invention is to provide a dispersion and emulsification apparatus which can process a wide range of viscosity for fluid to be processed.

Additionally, for the purpose of solution of the above-mentioned problems, the present invention provides a grinding apparatus which performs grinding that is absolutely required in the recent development of nanotechnology. Namely, the grinding apparatus makes it possible to perform highly precise grinding, preventing any inclusion of impurity, having a simple structure for ensuring high safety, and being manufactured at a low cost. Furthermore, the grinding apparatus may act to constantly grind a substance between two whetstones to a particle below a micron size, and cope with a wide range of substances in terms of the form and size of particles, specific gravity, degree of moisture, and various natures and properties of substances consisting of several kinds of particles which are different in form, size, specific gravity, degree of moisture.

Moreover, for solution of said problems, the present invention is made based on said circumstances for deaerating process to provide a deaerator including an atomizing mechanism totally different from said conventional counterparts, so that removal of micro-scale bubbles, which was not available in the past, can be performed by atomizing a substance to a finer degree. The deaerator may avoid the necessity of troublesome cleaning operation for punching plates and screens.

BRIEF SUMMARY OF THE INVENTION

A processing apparatus for fluid in accordance with a first aspect of the present invention comprises a fluid pressure applying mechanism for applying predetermined pressure to fluid to be processed; at least two processing portions of a first processing portion 10 provided in a tight-closed passage through which the fluid under predetermined pressure flows and a second processing portion 20 which is movable to or away from the first processing portion 10; at least two processing faces of a first processing face 1 and a second processing face 2, both of which are respectively disposed opposite to each other on said processing portions 10, 20; a rotary drive mechanism for relatively rotating the first and second processing portions 10, 20, where the fluid is processed. In the processing apparatus, at least the second processing portion 20 of the first and second processing portions 10, 20 is provided with a pressure receiving face as set in a predetermined ratio of balance while at least one part of the pressure receiving is constituted of the second processing face 2. The fluid under said pressure is allowed to travel between the first and second processing faces 1, 2, which relatively rotate and are movable to or away from each other in the course of forming fluid film with predetermined thickness, whereby said fluid is processed to a desired condition of dispersion, emulsification, mixture, grinding, attrition or atomization.

Dispersing and emulsifying process, referred hereinafter, involves agitation and attrition as well as dispersion and emulsification.

The first aspect of the present invention provides a processing apparatus for fluid (dispersing and emulsifying apparatus), wherein the first processing face 1 and the second processing face 2 are positioned with a predetermined micro-scale interval of the clearance therebetween, the arrangement of which is based on an idea fully different from the conventional idea of stabilizing the interval mechanically.

As discussed above, setting of a predetermined ratio of balance on the pressure receiving face is achieved by a principle employed in a mechanical seal. The predetermined pressure as applied to the fluid to be processed acts on the first and second processing portions 10, 20 to move to or away from each other.

The second processing face 2 as a pressure receiving face is subjected to said predetermined pressure to move both portions away from each other.

As needed, besides the second processing face 2, the second processing portion 20 may be provided with a pressure receiving face for access control (access control face) on the other side of the second processing face 2, and a pressure receiving face of separation control (separation control face) on the same side where the second processing face 2 is formed.

In this instance, under the predetermined pressure applied to the fluid to be processed, the second processing face 2 and the separation control face may generate a force to urge the second processing portion 20 to move away from the first processing portion 10. However, if unnecessary, said separation control face may not be provided. (Here, if the separation control face is provided, both the second processing face and the separation control face shall be called separation face altogether. Unless provided, the second processing face 2 itself shall be the separation face).

And, under the predetermined pressure as applied to the fluid to be processed, the access control face may produce a force to urge the second processing portion 20 to move to the first processing portion 10. (If a plurality of access control faces are provided, all of them shall be referred to as access face altogether. If only one access control face is provided, it shall be the access face).

In this instance, the ratio of the area of the access face urging said predetermined pressure to allow both processing portions to access to each other against the area of the separation face is called the "ratio of balance". By making the area of the access face larger than that of the separation face, part of said predetermined force that urges both processing portions to access to each other can be made stronger than that of urging both processing portions to move away from each other.

On the contrary, by making the area of the separation face larger than that of the access face, part of said predetermined force that urges both processing portions to move away from each other can be made greater than that of that of urging both processing portions to access to each other.

Without provision of said access face, the predetermined force may be wholly accepted by the separate face into said separating force.

This may establish the equilibrium of the action of access or separation of both processing portions by the predetermined force applied to the fluid to be processed and a force urging both processing portions into access to each other or a force urging into separation, the forces having been created by other factor, whereby fluid film of desired micro-scale thickness can be formed between the first and the second processing faces 1, 2.

That is, the described adjustment of the interval between both processing portions into a micro-scale clearance makes it possible to produce a shear force of necessary magnitude against the fluid to be processed, with the result that a high-precision (homogeneous) disperse emulsification, or emulsification or dispersion as regulated into the orders of atomization, all of which being unavailable in the past, can be achieved. Namely, when the fluid travels between both processing faces, a stronger shear force may be applied to the fluid in a certain micro-scale clearance, so that secondary cohesive fine particles may be shattered into primary particles, large sized crystals be pulverized, or oil drops be atomized for subsequent efficient disperse emulsification. This enables the fluid in the emulsified or dispersed state of the order under 10 microns, which was unavailable in the past in the roll mill and colloid mill.

In addition, unlike the conventional media mill, this may also avoid the necessity of introducing media into the fluid, thereby preventing inclusion of impurity.

A processing apparatus for fluid in accordance with a second aspect of the present invention, as constituted by the processing apparatus of the first aspect of the present invention, is characterized in that it includes a buffer mechanism for adjusting vibration or alignment of at least one of the first and second faces 1, 2.

The provision of a floating structure equipped with the buffer mechanism enables absorption of alignment, such as run-out, and elimination of risk of accident caused by wear-out.

A processing apparatus for fluid in accordance with a third aspect of the present invention, as constituted by the processing apparatus of the first aspect of the present invention, is characterized in that it includes a displacement adjusting mechanism which is capable of adjusting displacement of the shaft due to wear-out of one or both of the first and second processing faces 1, 2 to maintain desired thickness of the fluid film formed therebetween.

Said displacement adjusting mechanism for adjusting the interval between the first and second processing faces to maintain the predetermined thickness of fluid film may secure uniform high-quality dispersion or emulsification over a long period of time.

A processing apparatus for fluid in accordance with a fourth aspect of the present invention of the present application, as constituted by the processing apparatus of the first aspect of the present invention, is characterized in that it includes a pressure adjusting mechanism for adjusting pressure applied to the fluid to be processed.

As foregoing, adjustment of the clearance between the first and second processing faces 1, 2 makes it possible to adjust the thickness of fluid film, thereby ensuring that any desired dispersion and emulsification will be achieved by means of said adjustment.

A processing apparatus for fluid in accordance with a fifth aspect of the present invention, as constituted of the processing apparatus of the first aspect of the present invention, is characterized in that it includes a separation control portion of defining the maximum interval between said first and second processing faces 1, 2 so as to prevent further separation of both processing faces 1, 2 beyond the set range.

This enables prevention of the interval between the first and second processing faces 1, 2 from further separation to ensure that the uniform dispersion and emulsification processes will be securely and smoothly achieved.

A processing apparatus for fluid in accordance with a sixth aspect of the present invention, as constituted by the processing system of the first aspect of the present invention, includes an access control portion of determining the minimum interval between said first and second processing faces 1, 2 so as to prevent both processing faces 1, 2 from further access to each other beyond the determined range.

This enables prevention of the interval between the first and second processing faces 1, 2 from further access to ensure that the uniform dispersion and emulsification processing will be securely and smoothly achieved.

A processing apparatus for fluid in accordance with a seventh aspect of the present invention, as constituted by the processing apparatus of the first aspect of the present invention, is designed to enable both of the first and second processing faces 1, 2 to rotate mutually in the opposite directions.

Such rotation of the first and second processing faces 1, 2 in the mutual opposite directions to each other may give rise to a stronger shear force, which enables dispersion and emulsification of more atomized order to ensure that more uniform and high-quality dispersion and emulsification will be achieved in an efficient manner.

A processing apparatus in accordance with an eighth aspect of the present invention, as constituted by the processing apparatus of the first aspect of the present invention, includes a temperature control jacket for controlling the temperature of one or both of said first and second processing faces 1, 2.

This particular temperature control jacket enables one or both of the processing faces 1, 2 to keep a proper temperature for dispersion and emulsification by heating or cooling them, thus achieving efficient and high-precise dispersion and emulsification processing.

A processing apparatus in accordance with a ninth aspect of the present invention, as constituted by the processing apparatus of the first aspect of the present invention, is characterized in that at least a part of one or both of the processing faces 1, 2 are subject to planishing with mirror finish.

Such planishing may bring about high-precise dispersion and emulsification processing as conducted between the first and second processing faces 1, 2, thus resulting in achieving more atomized dispersion and emulsification.

A processing apparatus in accordance with a tenth aspect of the present invention, as constituted by the processing system of the first aspect of the present invention, is designed to provide one or both of the processing faces 1, 2 with recesses.

The provision of said recess may bring the agitating ability to a higher level for more efficient process of dispersion and emulsification, and besides, a dynamic pressure as generated in the recess during operation may cause non-contact rotation to secure formation of fluid film.

A process apparatus in accordance with an eleventh aspect of the present invention, as constituted by the processing apparatus of the first aspect of the present invention, includes a different introduction passage independent of said fluid passage, at least one of said first and second processing faces 1, 2 having an opening which admits to said introduction passage so as to enable introduction of a substance from the introduction passage into the fluid being processed.

This arrangement is capable of introducing a separate substance or another fluid to be processed to the fluid being processed in order for mixture of them, thereby spreading a range of application of the apparatus.

A processing apparatus in accordance with a twelfth aspect of the present invention comprises a fluid pressure applying mechanism for applying predetermined pressure to fluid to be processed; at least two processing faces of a first face 1 and a second face 2, both of which are movable to or away from each other and connected with a tight-closed passage through which the fluid under the predetermine pressure flows; a face contact pressure applying mechanism for applying contact pressure between both processing faces 1, 2; and a rotary drive mechanism for relatively rotating the first and second processing faces 1, 2, thereby the fluid is processed therebetween. The fluid under said predetermined pressure is allowed to travel between the first and second processing faces 1, 2, which relatively rotate, while being applied to said face contact pressure, in the course of forming fluid film with predetermined thickness, whereby said fluid is processed to a desired condition of dispersion, emulsification, mixture, grinding, attrition or atomization.

In the processing apparatus for fluid in accordance with the twelfth aspect of the present invention, traveling of the fluid under the predetermined pressure between the first and second processing faces 1, 2 communicating with the tight-closed passage may fling off a force to act on the first and second processing faces 1, 2 for further separation of both faces from each other. On the other hand, contact pressure by the face contact pressure applying mechanism is applied between the first and second processing faces 1, 2 to pass said fluid into the interval between the first and second processing faces 1, 2 which are movable to or away from each other and rotatable simultaneously.

As a result, there will be acquired a balance between a force as applied by the fluid to urge both processing faces 1, 2 into separation and a contact pressure applied between both processing faces 1, 2 by the face contact pressure applying mechanism so as to keep the interval between the processing faces 1, 2 small as determined in advance, while the fluid flows through the space between both processing faces 1, 2 as it is forming fluid film.

Said face contact applying mechanism is designed to apply a force to urge the first and second processing faces 1, 2 into access to each other. Said mechanism may be constituted of any one of a spring, a pressure apparatus for emitting fluid pressure (positive pressure) such as pneumatic pressure or hydraulic pressure, or the pressure face which acts to urge both processing faces 1, 2 under predetermined pressure which is applied to the fluid to be processed.

On the contrary, a separation force for separating both processing faces 1, 2 against a pressing force (contact pressure) by said face contact applying mechanism involves said pressure as accepted by the pressure receiving face which may direct a predetermined force, as applied to the first and second processing faces 1, 2 into separation, a centrifugal force which is produced by relative rotation of the first and second processing faces 1, 2, a suction force which is produced by a suction apparatus using a fluid pressure (negative pressure) such as pneumatic pressure or hydraulic pressure, or a force by viscosity of the fluid to be processed.

The provision of said ratio of balance may compare the size of pressure acting as a pressing pressure by means of the face contact applying mechanism and pressure acting as a separation force, both pressure constituting the predetermined pressure as applied to the fluid to be processed.

While forming fluid with predetermined micro-scale thickness (namely, fluid film), said fluid is adapted to travel through the interval between both processing faces 1, 2 in the state of equilibrium of said contact pressure and separation force. Said different conditions are adjusted in a manner of obtaining the predetermined thickness of the film to retain the interval between both processing faces in a micro-scale width.

A processing method for fluid in accordance with a thirteenth aspect of the present invention comprises steps of applying predetermined pressure to fluid to be processed; connecting at least two processing faces of a first processing face 1 and a second processing face 2, which are movable to or away from each other, with the tight-closed passage through which the fluid under the predetermined pressure flows; applying a face contact pressure which may urge both processing faces 1, 2 to access to each other; relatively rotating the first and second processing faces 1, 2; and allowing the fluid to travel between the first and second processing faces 1, 2 in their rotation, thereby the fluid is processed therebetween. Said predetermined pressure as applied to the fluid provides at least a separation force for separating both processing faces 1, 2 by holding the balance established between the separation force and the contact pressure by the medium of the fluid between the processing faces 1, 2, the balance maintaining the interval therebetween in a micro-scale width, the fluid traveling therebetween as fluid film with predetermined thickness, whereby said fluid is processed to a desired condition of dispersion, emulsification, mixture, grinding, attrition, or atomization.

A processing apparatus (attrition mill) for fluid in accordance with a fourteenth aspect of the present invention comprises at least two processing members (grinding members) of a first member 101 and a second member 102, which are placed opposite to each other and at least one of which rotate to the other, to perform the processes such as dispersion, emulsification, mixture, grinding, attrition, or atomizing, wherein fluid is fed from the center of said rotary motion to the interval between the first and second processing members 101, 102, and then discharged outside thereof. At least one of the first and second processing members 101, 102 is arranged so as to be movable to or away from the other. A biasing mechanism 103 acts on both processing members 101, 102 to at least access to each other. Said first and second processing members 101, 102 comprise a dynamic pressure generating mechanism 104 which may direct a force of the fluid traveling therebetween to separate both members.

The fluid, as referred hereto, includes a liquid containing solid, and a gas containing solid as well as liquid and gas. This fluid shall include a general substance, whether it is to be processed or not.

The attrition mill, as referred hereto, involves a unit of performing emulsification and dispersion or an atomizer, as well as a unit performing grinding and attrition.

A processing system (attrition mill) in accordance with a fifteenth aspect of the present invention comprises at least two processing members of a first processing member 101 and a second processing member 102, both of which are placed opposite to each other and at least one of which rotate to the other to perform the process such as dispersion, emulsification, mixture, grinding, attrition, or atomization, wherein fluid is fed from the center of said rotary motion to the interval between the first and second processing members 101, 102, and then discharged outside of said members. At least one of said first and second processing members is arranged so as to be movable to or away from the other. A biasing mechanism 103 acts on both processing members 101, 102 to at least access to each other. Said both processing members 101, 102 respectively include a flat portion planished with mirror finish, and one of the processing members has grooves formed on the flat portion thereof. Each of said grooves stretches outward from the center of the processing member, and has a flow limiting portion for limiting the fluid traveling outward from the center of the processing member after it has passed through said groove.

A processing apparatus for fluid (attrition mill) in accordance with a sixteenth aspect of the present invention, as constituted of the processing apparatus for fluid of the fifteenth aspect of the present invention, is characterized in that said flow limiting portion is formed to generally decrease the sectional area of the groove from the inner part thereof toward the periphery of the processing member.

A processing apparatus for fluid (attrition mill) in accordance with a seventeenth aspect of the present invention, as constituted of the processing system of one of fourteenth and fifteenth aspects of the present invention, characterized in that at least one of said first and second processing members 101, 102 is provided with a floating mechanism, which enables both processing members 101, 102 to access to or separate from each other, wherein an eccentric behavior of at least one of both processing members 101, 102 resulting from the rotary motion may be absorbed by the other.

A processing apparatus for fluid (attrition mill) in accordance with an eighteenth aspect of the present invention comprises at least two processing members of a first processing member 101 and a second processing member 102, both of which are placed opposite to each other and at least one of which rotate to the other to perform the process such as dispersion, emulsification, mixture, grinding, attrition, or atomization, wherein fluid itself to be processed or transporting a substance to be processed is fed from the center of said rotary motion to the interval between the first and second processing members 101, 102, and then discharged outside of said members. This specific system (attrition mill) comprises a floating mechanism, a biasing mechanism, and a dynamic pressure generating mechanism. The floating mechanism is arranged so as to enable said first and second processing members 101, 102 to access to or separate from each other and to change the directions of the rotary shafts of both processing members 101, 102. The biasing mechanism is designed to bias said processing members 101, 102 at lease in the direction of accessing to each other. The dynamic pressure generating mechanism serves to convert a force by the fluid traveling through the interval between both processing members 101, 102 into separation of both processing members 101, 102, thereby the micro-scale clearance therebetween may range from 0.1 to 10 microns.

In according with the processing systems for fluid (attrition mill) of the fourteenth to eighteenth aspects of the present invention, by employing said arrangement, the dynamic pressure generating mechanism 104 may give rise to a separation force between both processing members (grinding members) 101, 102 by means of a force of the fluid traveling between both processing members 101, 102 against a biasing motion of the biasing mechanism 103, and the balance between said biasing motion and said separating force may secure a micro-scale interval between both processing members 101, 102 as required for proper processing, the interval being unavailable by the conventional means.

In particular, with the processing apparatus for fluid (attrition mill) in accordance with the fifteenth aspect of the present invention, said dynamic pressure generating mechanism 104 is provided with more preferable means. That is, both processing members (grinding members) of said processing system for fluid (attrition mill) in accordance with the second aspect of the present invention has a flat portion planished with mirror finish, and grooves formed on either of said flat portions guides the fluid flow outward from the center of the processing members (grinding members), which grooves being defined and encompassed by the planished flat portion and the flow limiting portion. In this connection, the flow limiting portion hinders flow of the fluid passing through the grooves, so that the fluid will enter the interval between both flat portions as biased to each other by the biasing mechanism, which may securely achieve micro-scale interval that is suitable for attrition and grinding, but impossible by conventional means.

In the processing apparatus for fluid (attrition mill) in accordance with the sixteenth aspect of the present invention, as constituted of the processing apparatus for fluid of the fifteenth aspect of the present invention, wherein the sectional area of the groove gradually decreases from the center of rotation to the outside of processing members (grinding members), so that said flow limiting portion will wholly receive a force of the fluid passing thereof, thus securely achieving said micro-scale interval.

Moreover, with the processing apparatus for fluid (attrition mill) in accordance with the seventeenth aspect of the present invention, not only access or separation between both processing member 101, 102 but an eccentric behavior arising on at least one of both processing member 101, 102 from their rotary motion may be absorbed by the other member owing to the floating mechanism. This enables correction of any irregularity in the interval between both flat portions (or both processing members 101, 102) which may occur in each of positions by deformation of the processing members from the rotary motion or exothermic heat, to ensure that more uniform processing will be achieved.

That is, the floating mechanism may deal with any possible run-out of the rotating shat, expansion of the shaft, face deflection of the first processing member (first grinding member) and oscillation of same during said rotary motion.

In accordance with the processing apparatus for fluid (attrition mill) of the eighteenth aspect of the present invention, the balance of forces generated by the biasing mechanism and the dynamic pressure generating mechanism may lead to a micro-scale interval of 0.1 to 1.0 micron between both processing members (grinding members), thus resulting in realization of finer attrition and grinding that are unavailable with the conventional art.

A deaerator with atomizing apparatus of removing bubbles from the atomized substance, in accordance with a nineteenth aspect of the present invention, is characterized in that the processing apparatus of any one of the first, twelfth, fourteenth, fifteenth, and eighteenth aspects of the present invention is employed as an atomizing apparatus.

A deaerator with atomizing apparatus of removing bubbles from the atomized substance, in accordance with a twentieth aspect of the present invention, has the following structure.

The atomizing apparatus comprises at least two disks of a first disk and a second disk, both of which are placed opposite to each other and at least one of which rotate to the other, and an interval retaining mechanism for retaining a predetermined interval between the disks. The opposite faces of said disks are the processing faces and planished with mirror finish. Said atomizing apparatus has an inlet portion of supplying a substance to be processed between said processing faces, and a discharge portion of discharging the processed substance therefrom, so that atomization of the substance is processed between both processing faces in rotation. Atomization, as referred hereto, naturally means reduction of the diameter of atomized particles or droplets for the purpose of increase of surface area of the substance to be processed, as well as, for example, reduction of the size of the particles in case of emulsion, suspension, or liposome.

The deaerator, which is designed to vaporize and extract part of the compositions of the substance, involves degassing apparatus, monomer remover, solvent medium remover.

A deaerator with atomizing apparatus of removing bubbles from the atomized substance, in accordance with a twenty-first aspect of the present invention, has the following structure.

The atomizing apparatus comprises at least two processing members of first processing member and a second processing member, a floating mechanism, a biasing mechanism, and a separation mechanism. Each of the processing members includes processing faces opposite to each other, one of which rotate to the other and an atomizing processing may carry out between both processing faces, both of which are planished with mirror finish. A substance to be processed is fed therebetween. At least one of the first and second processing members is provided with a floating mechanism, which enables both processing members to access to or separate from each other, while an eccentric behavior of at least one of both processing members arising from the rotary motion may be absorbed by the other. The biasing mechanism is designed to bias said processing members at least in the direction of accessing to each other. The separating mechanism is designed to urge both processing members into separation. Additionally, it may secure a micro-scale interval between the processing members in rotation against the action of the biasing mechanism.

A deaerator with atomizing apparatus in accordance with a twenty-second aspect of the present invention, as constituted of the deaerator with atomizing apparatus of the twenty-first aspect of the present invention, is characterized in that it includes a vacuum pump of extracting a substance which has passed through the interval between the first and second processing members.

The deaerators with atomizing apparatus in accordance with the nineteenth to twenty-second aspects of the present invention, which are designed to atomize a substance before deaeration, provides a novel means of conducting atomization of the substance between both processing faces, one of which being in rotary motion, said arrangement eliminates the conventional combination of the punching plate and the mesh as needed for atomization, thereby eliminating cleaning of those members.

In addition, this particular deaerator has two advantages. One is that the diameter of droplets when sprayed by the deaerator may be enstronged to help increasing the surface area or interfacial area as exposed to the vacuum environment for increase of deaeration ability. The other is that, the deaerator serves to emulsify and dearate the substance to be processed in a single apparatus, while common procedure needs different apparatus. The deaerator of the present invention no longer needs such a procedure.

As described above, when processing liquid containing bubbles, the deaerator easily disperse the bubbles inside the liquid by the atomizing apparatus. It is not restricted to said liquid containing bubles that can be processed. Referring to a liquid containing more than two liquid components, the deaerator in the present invention may also separate different liquid components as by atomizing one of liquid components for subsequent vaporization. Furthermore the substance to be processed may be included in the category of the intended substance as long as it is a solid mixture or solid chemical compound, and its solid matter can be eliminated by accelerated evaporation due to atomization. For example, polymer is to be processed, unnecessary monomer (volatile matter) contained in said polymer can be removed by being atomized for evaporation. When a mixture of solid and liquid is to be processed, any one of the two components can also removed by atomizing for evaporation.

Additionally, the deaerator is capable of removing water contained in the substance in the form of vapor by atomization.

In accordance with the twenty-first aspects of the present invention, the floating mechanism as mounted on said deaerator with atomizing apparatus may secure retention of a micro-scale interval between both processing faces which is needed for atomization without influence of any distortion by rotation or by heat arising from the rotation with difference between the coefficients of expansion of parts of said processing faces, which may ensure more highly accurate process.

With the twenty-second aspect of the present invention, the atomized substance may be decompressed by the vacuum pump so as to transfer the substance reliably. Decompression by the vacuum pump can accelerate evaporation gasses contained in the atomized substance to ensure that the separation of the substance from the liquid component will more reliably be achieved.

Specifically, in case of deaeration, for example, by decompressing the substance through the vacuum pump down to a level of vacuum or close to vacuum, the facial area of the atomized substance increases, and fine bubbles swell, so that gasses, solvents, monomers (volatile matter) can be removed by vaporization into steam (if such gasses are to be extracted, the intended operation may also be achieved by means of the like procedure).

The degree of vacuum (degree of decompression) may be set to such a level that is suitable for separation of what is to be evaporated and that what is to be left.

In particular, the deaerator with atomizing apparatus in accordance with the nineteenth aspect of the present invention which employs as a atomizing apparatus the processing systems for fluid in accordance with any one of the fourteenth, fifteenth, and eighteenth aspects of the present invention may provide, for purpose of solution of said problems, a deaerator, of a simple structure and high productivity rate, which may perform accurate atomizing apparatus based on a unique idea that the shaft sealing mechanism for mechanical seal is used as means for atomization, set the interval between at least two processing faces rotatable relatively to each other to a predetermined micro-scale, supply a stronger shear force to fluid to be processed, and process the fluid in a broad range of viscosity as a deaering apparatus.

By adjusting the interval between the processing faces 1, 2 to a micro-scale one, the nineteenth to twenty-second aspects of the present invention may supply fluid to be processed with a shear force of necessary magnitude, thereby resulting in achievement of super atomization, which was unavailable in the past. That is, when fluid to be processed travels between the processing faces 1, 2, a stronger shear force may be given to the fluid in a certain micro-scale interval therebetween and the fluid will be sprayed through the interval, thereby atomization of the order under 10 microns is available, and so is the extraction of fine bubbles at the corresponding level. Namely, the interval between the processing portions 10, 20 can be reduced to such a size as unavailable by means of the conventional methods, which may lead to formation of finer bubbles.

In the nineteenth aspect of the present invention, a pressure control mechanism of applying pressure to fluid to be processed can be employed with the deaerator with atomizing apparatus of the first aspect of the present invention. Since this arrangement is capable of adjusting the interval between the first and second processing faces 1, 2, thickness of said fluid film will follow. Accordingly, desired atomization can be selected by said control, deaerating ability can be increased according to the properties of fluid to be processed in viscosity, and bubbles to be removed may be treated in terms of the size (fineness) carefully.

DETAILED DESCRIPTION OF THE PREFERRED EMBODIMENT

The embodiments of the present invention will be described with reference to the drawings.

FIGS. 1 and 2(A) illustrate one embodiment of the present invention. FIG. 1 is a partially cutaway longitudinal sectional view of an atomizing apparatus G of a deaerator in accordance with the present invention. FIG. 2(A) is a longitudinal sectional view showing the main part of the deaerator as per FIG. 1.

For the convenience of explanation, an arrow U indicates the upward direction, and S the downward direction in the drawings.

First, the explanation will be made of the construction of the deaerator.

The deaerator comprises an atomizing apparatus G, and a known decompressing device (not shown in this embodiment) such as vacuum pump.

Said atomizing apparatus G is proper for atomizing operation of the order of microns to nanometers, specifically for the deaerating process for the removed (extracted) components from a single liquid, liquids, liquid and solid (powder), solids (powder), gas and liquid, or gas and solid (powder).

As shown by FIG. 1, the atomizing apparatus comprises a first holder 11 (mating ring holder), a second holder 21 (compression holder) disposed before and above the first holder 11, a casing 3 covering the first holder 11 together with the second holder 21, a fluid pressure applying mechanism p, and a contact pressure applying mechanism 4.

The explanation will be made of the construction of the atomizing apparatus.

The first holder 11 is provided with a first processing portion 10, a rotary shaft 50, and agitating blades 6.

The first processing portion 10 is of a metallic annular structure, provided with a first processing face 1 planished with mirror finish.

The rotary shaft 50 is securely fixed in the center of the first holder 11 by means of fasteners 51, as bolts, with its rear end connected with a motor drive 5 (rotary motion imparting mechanism), operative to transmit motion from the motor drive 5 to the first holder 11 for rotating the latter. The first processing portion 10, which is mounted to the frontal part (upper end) of the first holder 11 and concentric with the rotary shaft 50, may rotate in conjunction with said first holder 11 in response to the rotation of the rotary shaft 50. The agitating blades 6 are intended to perform pre-agitation (a preliminary process for atomization), secured to the first holder 11 by its frontal portion (upper face) inside of the first ring-formed processing portion 10 in a manner to be concentric with the rotary shaft 50.

The first holder 11 has a receiving portion placed in the frontal part (upper face) thereof for receiving the first processing portion 10, in such a fashion that the receiving portion embraces the first processing portion 10 and an O-ring together so as to attach the first processing portion 10 to the first holder 11. Additionally, the first processing portion 10 is fixed by means of a pin 12 against rotation in respect of the first holder 11. Instead of the pin 12, the fixing procedure may be carried out by any means such as shrink-fit.

Said first processing face 1 protrudes from the first holder 11, facing the second holder 21 side. The first processing face 1 is preferably subjected to planishing with mirror finish, as grinding, rapping, polishing, after fitted into the first holder 11.

Usable materials for the first processing portion 10 involves ceramic, sintered metal, wear-resistant steal, other hardened metals, or lined, coated, plated rigid materials. Especially, it is preferable that being of a rotary type, the first processing portion 10 be made of light materials.

Said casing 3 is a container with bottom, composed of a shaft receiving aperture 31 and a discharge portion 32, and loaded with said first holder 11 in its internal space 30. The shaft receiving aperture 31 is provided in the center of the bottom of the casing 3 to establish open communication between the inside and the outside of the casing 3 as a through-hole for receiving the rotary shaft 50. The leading end of the rotary shaft 50 is inserted in the casing 3 through said shaft receiving aperture 31 from the rotary drive 5 located outside of (beneath) the casing 3 so that the first holder 11 in the casing 3 may be coupled with the rotary shaft 50, as discussed above.

The second holder 21 is provided with a second processing portion 20, an introducing portion 22 for fluid to be processed, and the contact pressure applying mechanism 4.

The second processing portion 20 is an annular element called compression ring, and includes a second planished processing face 2, and a pressure receiving face 23 (afterward referred to as separation control face 23) arranged adjacent to said second processing face 2 at the inner side of the second processing face 2. The separating adjustable face 23 is an angular face. The second processing face 2 is planished by the method as employed for the first processing face 1. The second processing portion 20 may be made of the same material as that of the first processing portion 10. The separation control face 23 is laid adjacent to the annular second processing portion 20 in the inner peripheral face 25.

The second holder 21 has on the bottom (lower portion) a receiving portion 40, which contains said O-ring and the second processing portion 20. The second processing portion 20 is kept stationary against rotation by a member 45 in respect of the second holder 21. Said second processing face 2 juts out over the second holder 21.

As shown in FIG. 1, the second holder 21 is so arranged in an opening (upper portion) of the casing 3 as to cover said opening in order to tightly close the inner space 30 of the casing 3 by the use of a known closing means 33. In this state, the second processing face 2 is laid across from the first processing face 1 of the first processing portion 10 within the casing 3. Between the first and second processing faces 1, 2, the inner sides (central sides) of the first processing portion 10 and the second processing portion 20 provide an inlet portion for a substance to be processed (as defined in claim 1), and the outsides of the first processing portion 10 and the second processing portion 20 an outlet portion for the substance to be processed (as defined in claim 1).

The fluid pressure applying mechanism p is connected with said introducing portion 22 at the outside (upper portion) of the second holder 21. The fluid pressure applying mechanism p is a compression machine, such as compressor, which applies a certain amount of lead-in pressure to the substance to be processed for atomization.

The contact pressure applying mechanism 4 is adapted to jam by pressure the second processing face 2 to, or push the same close to the first processing face 1, so that the fluid film of said predetermined thickness is generated by the balance between the contact pressure and a force, such as fluid pressure (that of fluid to be processed), acting to separate the processing faces 1, 2. In other words, the interval between the processing faces 1, 2 may keep its predetermined micro-scale width.

Specifically, in this embodiment, the contact pressure applying mechanism 4 is constituted by said receiving portion 41, a spring receiving portion 42 as provided in the innermost of the receiving portion, a spring 43, and air introducing portion 44.

However, all the contact pressure applying mechanism 4 has to do is include at least any one of said receiving portion 41, and said spring receiving portion 42, the spring 43, and the air introducing portion 44.

The receiving portion 41 subjects the second processing portion 20 to free fit in such a manner that the place where the second processing portion 20 is positioned within the receiving portion 41 may be displaced more deep or less.

Said spring 43 has one end abutting on the spring receiving portion 42 in its innermost, and the other end abutting on the frontal portion (upper portion) of the second processing portion 20 within the receiving portion 42. Though FIG. 1 shows a single piece of spring 43, it is preferable that a plurality of springs 44 press different parts of the second processing portion 20 respectively. This is because an increased number of springs 43 may impart more uniform pressure to the second processing portion 20. Consequently, the second holder 21 is preferably of a multiple type, having several to dozens of springs 43.

As set forth previously, the present embodiment enables introduction of air through the air introducing portion 44 into the receiving portion 41. This makes it possible to impart air pressure to the second processing portion 20 as pressing force in cooperation with the spring 43, using the intermediate space between the receiving portion 41 and the second processing portion 20 as a pressurizing chamber. Therefore, the adjusting of air from the air introducing portion 44 may lead to that of contact pressure (which is applied by the second processing portion 2 to the first processing face 1) during operation. A mechanism of making use of other fluid pressure such as hydraulic pressure as a pressing force is applicable instead of the air introducing portion 44 using air pressure.

The contact pressure applying mechanism 4 can also function as a displacement controlling mechanism of supplying part of said pressing force (contact pressure) for control, and a buffer mechanism.

To be specific, the function of the contact pressure applying mechanism 4 as a displacement adjusting mechanism is to maintain an early pressing force by controlling the air pressure even when it may axially move due to possible axial extension or wear at the start of or during operation. In addition, as described above, the contact pressure applying mechanism 4 may also function as a buffer mechanism for vibration or alignment by employing a floating mechanism of retaining the second processing portion 20 movably.

In accordance with the deaerator of the first embodiment having the abovementioned arrangement, the deaerating operation is achieved by the following actions.

As a first step, fluid to be processed is supplied under the influence of a certain amount of pressure fed from the fluid pressure applying mechanism p through an introducing portion 22 from the fluid pressure applying mechanism p to the inner space of the closed casing 3, while the first processing portion 10 is driven by the rotary drive 5 (rotary drive mechanism) into rotation, whereby the first and second processing faces 1, 2 will rotate relative to each other over the micro-scale clearance therebetween.

The fluid as introduced (from the inlet portion) into the inner space of the casing 3 turns to fluid film between both of the processing faces 1, 2 with the micro-scale interval therebetween, where the fluid film will be atomized under a shearing force as generated by the rotary motion of the first processing face 1. The reduction of the interval between the first and second processing faces 1, 2 to the orders of 1 micron to 1 millimeter (in particular, from 1 to 10 microns) may enable the ultra-fine atomization in several nanometers.

The processed fluid travels between the processing faces 1, 2 (out of the outlet portion) and is discharged to the outside at the discharge portion 32. Then, the fluid is scattered in a spray by means of said decompressing apparatus within the atmosphere as vacuumed or decompressed, and some of the resultant sprays which have fallen down in fluid will be recovered as liquid matter after deaeration.

In the embodiment, the casing 3 is provided, as shown in FIG. 1. However, not shown, provision of the casing 3 in an atomizing apparatus G is not essential. The deaerator may be used, for example, as a decompressing tank (vacuum tank), in which the atomizing apparatus G may be arranged. In this instance, it is natural that said discharging portion 32 should not be provided in the atomizing apparatus G.

The agitating blades 6 rotates under the influence of said fluid pressure to agitate said fluid before the processing operation between said processing faces 1, 2.

As discussed above, the adjustment of the first and second processing faces 1, 2 can be achieved to obtain the separation of microns between both of the faces, the clearance of which is unavailable in the conventional mechanical setting. Next, the relative mechanism will be described.

The first and second processing faces 1, 2 are movable to or away from each other, and rotatable relative to each other. In this embodiment, the first processing face 1 is of a rotatable type, and the second processing face 2 is axially slidable to move to or away from the first processing face 1.

In this connection, this embodiment makes arrangements for the axial position of the second processing face 2 to be established with a degree of accuracy of the order of microns by the balance of forces (the aforementioned contact pressure and the separating force) to acquire a micro-scale interval between the processing faces 1, 2.

Referring to the face contact pressure applying mechanism 4, the contact pressure may involve the positive pressure (air pressure) fed from the air introducing portion 44, if any, and the pressing force of the spring 43.

On the contrary, the separation force may involve fluid pressure acting on the pressure face at the separation side (i.e. the second processing face 2 and the separation control face 23), the centrifugal force due to the rotation of the first processing face 1, and the negative pressure applied to the air introducing portion 44, if any.

The balance between said forces may stabilize the second processing face 2 with the stay in the position regularly and slightly remote from the first processing face 1, to ensure that a micro-scale interval with a degree of accuracy of microns will be obtained.

The separation force will be further specified.

First, as regards fluid pressure, the second processing portion 20 located midway of the closed passage receives a lead-in pressure (fluid pressure) from the fluid pressure applying mechanism p, when the faces (the second processing face 2 and the separation control face 23) opposite to the first processing face 1 within the passage provides a pressure receiving face at the separation side, and the fluid pressure acts on this pressure receiving face so as to give rise to a separation force due to the fluid pressure.

Next, with reference to the centrifugal force, if the first processing portion 10 is actuated to run at a high speed, the centrifugal force acts on the fluid, and part of the centrifugal force will turn to a separating force which may act to make the processing faces 1, 2 recede from each other.

Furthermore, if a negative pressure from said air introducing portion 44 is imparted to the second processing portion 20, said negative pressure will function as a separation force.

In the present application, the force which serves to separate the first and second processing faces 1, 2 is defined as a separating force, so the forces as described above shall not be precluded from the separation force.

As aforementioned, the fluid films suitable for making desired atomization between the processing faces 1, 2 may be formed by establishing the balance between the separation force and the contact pressure exerted by the face contact pressure applying mechanism 4 through the medium of the fluid to be processed between the processing faces 1, 2 in the tightly closed passage for the fluid. In this way, the atomizing apparatus is capable of maintaining the micro-scale interval between the processing faces 1, 2 by forcing the fluid film into the interval therebetween, the interval of which was unobtainable from the conventional atomizers. The highly accurate deaeration has been achieved thanks to this system.

In other words, the fluid film between the processing faces 1, 2 can be processed into a desired thickness by adjusting said separation force and contact pressure for atomization as needed. Therefore, if the fluid film is to be made thinner, the contact pressure or the separation force may be adjusted in a manner that the contact pressure will become greater than the separation force. On the contrary, if the fluid film is to be made thicker, the separation force or the contact pressure may be adjusted in a manner that the separation force will become greater than the contact pressure.

To increase the contact pressure, the positive pressure (pneumatic pressure) in the face contact pressure applying mechanism 4 may be given from the air introducing portion 44, or a spring 43 with stronger pressing force may be used, or the number of the spring may be increased.

To increase the separation force, the lead-in pressure of the fluid pressure applying mechanism p, or the areas of the second processing face 2 and separation control face 23 may be increased, and in addition, the rotation of the second processing portion 20 may be adjusted to increase the centrifugal force, or the negative pressure (pneumatic pressure) may be given from the air introducing portion 44. Though the spring 43 used here is a push spring which flings off a pressing force in the direction in which it expands when released, it may be constituted by a part or the whole of the contact pressure applying mechanism 4 as a drag spring which emits a force in the direction in which it is retracted.

Besides the above-described, the properties of fluid to be processed, such as viscosity, may be added as an element of increase or decrease of the contact pressure and the separating force, and the adjustment of the fluid to be processed in properties can be achieved as that of said elements.

The fluid pressure, as involved in the separating force, which acts on the pressure face at the separation side (i.e. the second processing face 2 and the separation control face 23) is understood to be a force constituting the opening force in the mechanical seal.

In terms of the mechanical seal, the second processing portion 20 is corresponding to the compression ring. With the second processing portion 20 under fluid pressure, a force which serves to separate this second processing portion 2 from the first processing portion 1 is defined as opening force.

More specifically, if there are provided only pressure faces (i.e. the second processing face 2 and the separation control face 23) as in said first embodiment, the whole of the lead-in pressure provides the opening force. Besides, when the second processing portion 20 also has only a pressure face on its back (specifically, in the case of FIGS. 2(B) and 9, which will be described later), the difference between what may act as a separation force and what as a contact pressure among the lead-in pressures becomes an opening force.

Another embodiment of the second processing portion 20 will be explained with reference to FIG. 2(B).

As shown in FIG. 2(B), there is provided at the site protruding from the receiving portion 41 of the second processing portion 20 or the inner peripheral side an access control face 24 on the other side of the second processing face 2.

That is, in this embodiment, the contact pressure applying mechanism 4 is composed of the receiving portion 41, air introducing portion 44, and said access control face 24. But, the contact pressure applying mechanism 4 will do with any one of them.

The access control face 24 serves to supply contact pressure as one of the face contact pressure applying mechanism 4 which may generate a force of moving the second processing face 2 toward the first processing face 1 under the influence of a predetermined pressure applied to the fluid to be processed. On the other hand, the second processing face 2 and said separating control face 23 generate a force which may urge the second processing face 2 into separation from the first processing face 1 under the influence of the predetermined pressure applied to the fluid to be processed for partial supply of the separation force.

All the access control face 24 and the second processing face 2 (and the separation control face 23) are faces of receiving pressure from said fluid to be processed, and the generation of either one of forces, i.e. said contact pressure or the separation force is depended on the directions of these faces.

The ratio of the area A1 of the access control face 24 to the area A2 totaling that of the second processing face 2 of the second processing portion 20 and that of the pressure receiving face 23 at the separation side is referred to as the ratio of balance K, which performs an important role in the control of said opening force.

Both of the top ends of the access control face 24 and the pressure receiving face 23 at the separation side are defined in the inner periphery (top end line L1) of the annular second control portion 20. In this connection, the control of the ratio of balance is subsequent to the determination of the position of the base end line L2 in the access control face 24.

That is, with this embodiment, in using the lead-in pressure of the fluid to be processed, the total area of those of the second processing face 2 and separation control face 23 is made greater than that of the access control face 24, thereby ensuring that an opening force corresponding to the ratio of area will be produced.

Said opening force can be controlled by the medium of the fluid pressure by changing said balance line or the area A1 of the access control face 24.

The actual face pressure P on the sliding face (caused by the fluid pressure as involved in the contact pressure) may be calculated by the following formula.

$$P=P1\times(K-k)+Ps$$

Here, P1 designates the pressure of the fluid to be processed (fluid pressure), K said ratio of balance, k the coefficient of opening force, and Ps the spring and the back pressure.

By the adjustment of the actual face pressure P on the sliding face (based on the adjustment of the balance line), the interval between the processing faces 1, 2 may turn to a desired width of the clearance, thus forming fluid film from the fluid to be processed until at a desired processing level of atomization.

In general, the thinner the fluid film between the processing faces 1, 2, the finer the substance (fluid) to be processed may be made. On the contrary, with the thicker fluid film it will lead to a rough process of atomization and the throughput will become greater as per hour. Therefore, the adjustment of the interval (clearance) between the processing faces 1, 2 based on the control of said actual face pressure P on the sliding face (as referred to as "face pressure P" afterward) makes it possible to carry out atomization at a desired level.

To sum up this, for said rough atomization of the substance (fluid), the ratio of balance is made smaller, the face pressure lower, said interval of the clearance wider, and said fluid film thicker as well. For a finer atomization thereof, the ratio of balance is made stronger, the face pressure higher, said interval of the clearance narrower, and said fluid film thinner as well.

Thus, the access control face 24 is formed as part of the contact pressure applying mechanism 4, and the adjustment of the contact pressure or the adjustment of the clearance between the processing faces may be carried out at the point of its balance line.

As aforementioned, said adjustment of clearance must be performed in consideration of the pressing force of said spring 43 and air pressure of the air introducing portion 44. Also, other important parameter included the adjustment of fluid pressure, i.e. the lead-in pressure of the fluid to be processed, and of the centrifugal force of the first processing portion 10 (the first holder 11) in rotation.

As described above, this apparatus, referring to the second processing portion 20 and the first processing portion 10 which rotate to the second processing portion 20, is so arranged that the lead-in pressure of the fluid to be processed and the said centrifugal force thereof or contact pressure may achieve a balance to form fluid film with a predetermined thickness and to provide a desired shear force against the fluid way. At least one of the rings is of a floating structure so as to absorb the alignment such as run-out, thereby getting rid of the risk of contact-initiated wear.

The embodiment as shown by FIG. 2(B) is also identical to the embodiment as shown in FIG. 1 in the arrangement other than those consisting of said control faces.

Also, said pressure receiving face 23 at the separation side, as shown in FIG. 9 may not be included in the embodiment. In this case, said ratio of balance K is the ratio of the area A1 of the access control face 24 to the area A2 of the second processing face 2 of the second processing portion 20.

If the access control face 24 is provided as in said embodiment as per FIGS. 2(B) and 9, the area A1 of the access control face 24 will be greater than said area A2. That is, by establishing an imbalance type of mechanical seal, the predetermined pressure applied to the fluid to be processed will function as a contact pressure rather than generate opening force. There may also be such a case, in which a balance can be maintained between the processing faces 1, 2 by increasing other separation force.

With said embodiment, as indicated already, the more the number of spring 43, the better for the spring in order to impart a uniform stress to the sliding face (processing face). However, the spring 43 may be of a single-coiled type, as shown in FIG. 3 (A), which is made concentric with the annular second processing portion 20.

The said O-ring may be used to seal the gap between the second processing portion 20 and second holder 21. Alternatively, the O-ring may be replaced by a bellows 26 as in FIG. 3(B), or a diaphragm 27 as in FIG. 3(C), or may be used in conjunction with each of said elements.

As in FIG. 4, there is provided in the holder 21 a temperature control jacket 46 for controlling the temperature of the second processing face 2 (and the second processing portion 20) by heating or cooling the member. The casing 3 also includes a temperature control jacket 35 for the same purpose.

The temperature control jacket 46 represents a cavity where water travels and which is defined at the side of the receiving portion 41 so as to communicate with passages 47, 48 admitting to the outside of the second holder 21. One of the passages 47, 48 acts to introduce heating or cooling medium to the temperature control jacket 46, and the other acts to discharge said medium.

Provided between the outer periphery of the casing 3 and the covering portion 34 therefor, a temperature control jacket 35 inside the casing 3 is a passage for heating or cooling water.

In the present embodiment, like the second holder 21 and the casing 3, the first holder 11 may also include such a jacket.

In addition to the arrangements shown in FIGS. 1 and 2, a cylinder mechanism 7 as shown in FIG. 5 may be used as part of the contact pressure applying mechanism 4.

Said cylinder mechanism 7 comprises an empty space 70 formed within the second holder 21, a communicating portion 71 of connecting the empty space 70 to the receiving portion 41, a piston cylinder 72 which is contained in the empty space 70 and is connected to the second processing portion 20 through the communicating portion 71, a first nozzle 73 communicating with the upper portion of the empty space 70, a second nozzle 74 formed in the lower part of the empty space 70, and a pressing member 75 such as spring interposed between the lower portion of the empty space 70 and the piston cylinder 72.

The piston cylinder 72 is slidable in a vertical direction within the empty space 70. The sliding motion of the piston cylinder 72 urges the second processing portion 20 into vertical sliding, so that the clearance between the first and second processing faces 1, 2 can be changed.

Specifically, with the first nozzle 73 set in a connected position with a pressure source (not shown) such as compressor, by applying pneumatic pressure (positive pressure) from the first nozzle 73 down to the top of the piston cylinder 72 within the empty space 70, the piston cylinder 72 may be moved downward so as to narrow the clearance between the first and second faces 1, 2 (into a closed position). Additionally, with the pressure source (not shown) such as compressor connected with the second nozzle 74, by the application of the pneumatic pressure (positive pressure) from the second nozzle to the lower end of the piston member 72 within the empty space 70, the piston cylinder 72 is slidably moved upward so as to broaden the clearance between the first and second processing faces 1, 2 (into an open position). The control of the contact pressure may be achieved by the pneumatic pressure thus obtained through the nozzles 3, 74.

In the arrangement such that the piston member 72 has been set to abut on the upper end 70*a* of the empty space 70 even if there remains room between the upper end of the second processing portion 20 and the top of the receiving portion 20, the empty space 70 defines the upper limit of the width of clearance between the processing faces 1, 2. That is, the piston cylinder 72 and the upper end 70*a* of the empty space 70 may function as a separation control portion (a mechanism for restricting the maximum interval of the clearance between the processing faces 1, 2) of preventing further separation of the processing faces 1, 2.

Furthermore, by setting the piston cylinder 72 to get in touch with the lower end 70*b* of the empty space 70 even in the case of the processing faces 1, 2 not being joined together, the cylinder empty space 70 defines the lower limit of the width of the clearance between the processing faces 1, 2 at its lower end 70*b*. Namely, the piston cylinder 72 and the lower part 70*b* of the empty space 70 may function as an access control portion (a mechanism for restricting the minimum interval of the clearance between the processing faces 1, 2) of preventing the processing faces 1, 2 from further access to each other.

This may control the interval Z1 (in other words, the interval Z2 between the piston cylinder 72 and the lower end 70*b* of the empty space 70) between the piston cylinder 72 and the upper end 70*a* of the empty space 70 by means of the air pressure of said nozzles 73, 74, while restricting the minimum interval of the clearance.

Preferably, use is made of the nozzles 73, 74 connecting with different pressure sources respectively, or a single pressure source alternately.

Either type of pressure source of supplying positive pressure or negative pressure is usable. In the event of the connection of the negative pressure source such as vacuum and the nozzles 73, 74, the action as mentioned above goes to the contrary.

Alternatively, instead of provision of said other contact pressure applying mechanism 4, the cylinder mechanism 7 is provide as part of said contact pressure applying mechanism 4 to set the pressure of the pressure source as connected with the nozzles 73, 74 and the interval Z1, Z2 according to the viscosity and characteristics of fluid to be processed in a fashion to bring the thickness value of liquid film of the fluid to a desired level for atomization under a shear force. Additionally, in particular, the cylinder mechanism 7 is usable to increase the reliability of cleaning and sterilization by forcing the sliding portion open and closed.

As shown in FIGS. 6(A) to (C), the first processing face 1 of the first processing portion 10 may be formed with groove-like recesses 13 . . . 13 extending in a diametrical direction, specifically from the center of the first processing portion 10 outward. In this event, FIG. 6(A) shows that the recesses 13 . . . 13 bend or extend spirally on the first processing face 1. In FIG. 6(B), each recess 13 is seen to be in the form of a letter L, and in FIG. 6(C), the recesses 13 . . . 13 extend straight in all directions from the common center.

As shown in FIG. 6(D), the recesses 13 of FIGS. 6(A) to (C) are preferably made so inclined as to be deeper toward the center of the first processing face 1. The groove-like recesses 13 may continue in sequence or intermittence.

The formation of such recesses 13 may correspond to the increase of delivery of fluid to be processed (feed rate) or the decrease of calorific value, while having effects of cavitation control and fluid bearing.

With the described embodiments as per FIG. 6, the recesses 13 are indicated to be formed in the first processing face 1, but they may be located in the second processing face 2, or both of the faces.

In case of provision of no recess 13 or tapered sections, or concentration of these things in part of the processing faces, the degree of roughness of the processing faces 1, 2 (smooth surface) will have a greater effect on the fluid to be processed than in the faces formed with recesses 13. Therefore, in such an event, the smaller the particles of fluid to be processed, the lower the degree of roughness must be made (i.e. to render the face smoother). Especially, in case of atomization in nanometer size, referring to the degree of roughness of the processing face, the planishing as aforementioned is eminently advantageous to the application of desired shear force.

As shown in FIG. 7, there is provided, in addition to the introducing portion 22, a feed route 28 communicating with the second processing face 2 in the second processing portion 20. Said feed route 28 may be used to pass different matter or part of the dispersed fluid directly to the fluid being processed between the first and second processing faces 1, 2.

In the embodiment shown in FIG. 1, the first processing portion 10 (the first holder 11) is adapted to be urged by the rotary drive 5 into rotation relative to the non-rotatable second processing portion 20. Additionally, as in FIG. 8, the second holder 21 is connected with a counter rotary drive 52 through another rotary shaft 53 (referred to as sub rotary shaft 53 afterward), so as to be driven to rotation in the direction opposite to that in which the first holder 11 rotates, thus causing a greater shear force.

In this instance, said rotary shaft 50 and sub rotary shaft 53 are arranged in alignment with each other. Then, the introducing portion 22 for fluid to be processed is formed as a hollow passage as provided inside of the counter rotary drive 52 and sub rotary shaft 53, and the fluid to be processed is ousted from the other side (upper side) of the counter rotary drive 52 to the center of the second processing portion 20 by the use of a rotary joint (not shown). The fluid as introduced into the casing 3 and processed between the processing faces 1, 2 is discharged at the discharge portion 32 to the outside.

The system as shown in FIG. 8 is quite useful for a great shear force at a higher speed, in which the first and second holders 11, 21 may be either same or different in the speed of rotation (the number of rotation).

The embodiment in FIG. 8 provides no agitating blades 6.

Arrangements other than those as amplified in particular in the embodiments as per FIGS. 3 to 8 are identical to that of the embodiment as shown in FIG. 1 or that in FIG. 2.

The agitating blades 6 for pre-dispersion as provided in the embodiment of FIG. 1 may not be provided unless pre-dispersion is ever needed.

Though in the abovementioned embodiments, the fluid to be processed is to travel from the inside of the annular processing portion 20 or the first processing portion 10 to the outside, the fluid may be made to travel from the outside of the second processing portion 20 or the first processing portion 10 to the inside, thereby leading the fluid to pass through the interval between the first and second processing faces 1, 2 (not shown). For example, the discharge portion of the system as per FIG. 1 may be changed into an introducing portion, and the introducing portion as shown in FIG. 1 into a discharge portion. In this case, the pressure is applied from the discharge portion side as shown in FIG. 1. However, an arrangement may be made such that fluid is absorbed under negative pressure from the introducing portion side as shown in FIG. 1.

If the movement of the fluid to be processed is designed from the outside of the second processing portion 20 or the first processing portion 10 to the inside thereof, groove-shaped recesses 13 . . . 13 may be provided on the first processing face 1 of the first processing portion 10 to extend from the outside of the first processing portion 10 to its center, as shown in FIG. 6(E). By such an arrangement, it is preferable that said ratio of balance turn to be of more than 100% imbalance type. As a result, during rotary motion, a dynamic pressure arises on said groove-shaped recesses 13 . . . 13, and the processing faces 1, 2 can surely rotate with the least contact with each other, thereby ensuring immunity from the risk of wear due to contact.

In the embodiment of FIG. 6(E), the separation force resulting from the pressure of fluid to be processed is adapted to originate in the inner end 13*a* of the recess 13.

In the aforementioned embodiments, the casing 3 is defined to be of a tightly closed type, but it may have the first and second processing portions 10, 20 which are tightly closed only in the interior thereof and opened in the exterior thereof. That is, the passage is kept closed until fluid has passed between the first and second processing faces 1, 2, in such a manner that after the passage of the fluid, the passage is opened, and the fluid after processed will not receive the whole lead-in pressure.

As discussed before, the pressurizing system is preferably provided with a compressor. However, other means may be used as long as it is capable of applying a predetermined pressure to fluid to be processed at all times. For example, the weight (gravity) of fluid to be processed is always used to apply a certain pressure to the fluid.

To sum up, the atomizing apparatus in according to the embodiments as set forth is characterized in that it may function to apply predetermined pressure to fluid to be processed, to connect at least two first and second processing faces 1, 2 movable to or away from each other with and apply contact pressure, which may act to move the processing faces 1, 2 closer to each other, to the closed passage through which the pressurized fluid travels, to rotate the first and second processing faces 1, 2 relative to each other so as to generate fluid films which are used as a seal means as involved in the category of the mechanical seal by the use of the fluid, or to leak the fluid film out of the interval between the first and second processing faces 1, 2 on purpose contrary to the mechanical seal (rather than use the fluid as a seal), to subject the fluid in the form of a film to atomization, and to recover the resultant fluid.

Such an innovative atomizing method has made it possible to adjust the interval between both processing faces 1, 2 from 1 micron to 1 millimeter, in particular 1 to 10 microns.

In the above embodiments, the tight-closed passage is provided within the system, and the fluid to be processed is given pressure by means of the fluid pressure applying mechanism p as provided at the introducing portion side in the deaerator.

Alternatively, the fluid passage may be of an opened type, wherein fluid needs not be pressurized by the fluid pressure applying mechanism p.

FIGS. 10 to 13 illustrate one embodiment of said deaerator with atomizer. FIG. 10 is a longitudinal sectional view of the deaerator. FIG. 11 is a partially cutaway longitudinal section view. FIG. 12 is a plan view of the first processing member 1 provided in the atomizing apparatus as shown in FIG. 10. FIG. 13 is a partially cutaway longitudinal sectional view of the first and second processing members 1, 2.

As described above, fluid to be processed under the atmospheric pressure (said fluid to be processed will simply be called "fluid" as needed later on) or fluid of transporting a substance to be processed is supplied into the deaerator as shown in FIGS. 10 to 13.

As in FIG. 10, the deaerator comprises an atomizing apparatus G and a vacuum pump Q. The atomizing apparatus G comprises a first processing member 101 of a rotary type, a first holder 111 of holding said processing member 101, a second processing member 102 of a stationary type, a second holder 121 of securely holding said second processing member 102, a biasing mechanism 103, a dynamic pressure generating mechanism 104, a drive 105 of urging the first holder 111 and biasing mechanism into rotation, a housing 106, an introducing portion 107 of supplying (introducing) fluid, and a discharge portion 108 of discharging fluid to the vacuum pump Q.

Said first and second processing members 101, 102 are annular members composed of hollow columns respectively. The columns of both processing members 101, 102 have processing faces 110, 120 formed on the bottom thereof.

Said processing faces 110, 120 respectively include a planished flat portion. In this embodiment, the processing face 120 of the second processing member 102 is a flat face planished thereacross, and so is the processing face 110 of the first processing member 101. As shown in FIG. 13, the processing face 101 has a plurality of grooves 112 . . . 112 formed thereon. These grooves 112 . . . 112 extend radially from the center of the column constituting the first processing member 101 and in an outer peripheral direction of the column.

Referring to the planished processing faces 110, 120 of the first and second processing members 101, 102, surface roughness (Ra) is preferably 0.01 to 1.0 micron, and more preferably 0.03 to 0.3 micron.

The materials of the processing members 101, 102 are desirable to be of a hard quality, and adaptable to planishing. The hardness of the processing members 101, 102 should be greater than or equal to HV 1500, or more preferably over HV 1800. It is preferable that the materials of a small coefficient of linear expansion be used. This is because if there is an appreciable difference in coefficient of expansion between sections which may suffer heat built-up during atomization and the other sections, distortion will take place, thereby affecting the formation of proper clearances.

Desirable materials as such processing members 101, 102 involve SIC (silicon carbide of HV 2000 to HV 2500); SIC coated with DLC (diamond-like carbon of HV 3000 to HV 4000); WC (tungsten carbide of HV 1800); WC, ZrB2, BTC which are coated with DLC, and boron system ceramics represented by B4C (HV 4000 to HV 5000).

The housing 106, which is a tubular element with its bottom, is topped with said second holder 121, which has a lower side with which said second processing member 102 is loaded, and an upper side on which said introducing portion 107 is positioned. The introducing portion 107 is provided with a hopper 170 for containing a substance to be processed as introduced from the outside.

Said drive 105 includes a power source (not shown) such as electric motor, and a shaft 150 which may be energized to rotation by power from said power source.

Said shaft rotates 20,000 revolutions per minute (rpm) when the first processing member 101 is 100 millimeters (mm) in diameter, 10,000 rpm with the diameter of 200 mm, and 5,000 rpm with the diameter of 400 mm. That is, the first processing member 101 rotates about 6,300 meters per minute in terms of peripheral velocity. Such rotation could have been acceptably employed because of the arrangement that the processing faces 110, 120 can be protected against any dry contact therebetween.

As seen in FIG. 10, the shaft 150 is disposed within the housing 106 in a manner to extend in a vertical direction, and having its top end on which said first holder 111 is provided. The first holder 111 is intended to hold the first processing member 101, and is mounted on the shaft 150 as mentioned above, so that it may put the processing face 110 of the first processing member 101 in a position opposite the processing face 120 of the second processing member 102.

The first processing member 101 is secured integral to the upper central portion of the first holder 111 in the form of a column in such a manner that the former will never change its position in respect of the first holder 111.

On the other hand, there is formed a receiving recess 124 of receiving the second processing member 102 on the lower central portion of the second holder 121.

Said receiving recess 124 has an annular cross section. In the interior of the cylindrical receiving recess 124, the second processing member 102 is arranged in alignment with the receiving recess 124.

More specifically, there rests in said receiving recess 124 an annual element 123 which is separate from the second processing member 102. The receiving recess 124 has a projection 127 (pin) standing upright on the bottom face (top section 124*a*) of the receiving recess 124. A recess 126 into which said projection 127 may fit is provided on the face (upper face) looking to said top section 124*a* of the annular element 123. Said projection 127 is operative to stop the annular element 123 from swiveling in respect of the second holder 121. The projection 127 is contained with allowance in the recess 126.

The second processing member 102 is laid on the other side (downward) of the top portion 124*a* of the receiving portion 124 across the annular element 123. A projection 125 (pin) is provided on the other side (lower face) of the annular element 123 relative to the top portion 124*a*. There is provided a recess 122 of receiving said projection 125 on the other side of the second processing member 102 relative to the grinding face 120. The projection 125 is operative to stop the second processing member 102 from swiveling in respect of the annular element 123. The projection 125 rests in the recess 123 with allowance.

The second holder 121 is provided with said biasing mechanism 103, which is preferably constituted of rubber O-rings or resilient matters such as spring. Specifically, in this embodiment, said annular element 123 has a plurality of through-holes 131 . . . 131 formed between both (upper and lower) end faces thereof, with a plurality of springs 130 . . . 130, which act as bias mechanism 103, mounted in said through-holes 131 . . . 131. This indicates that the biasing mechanism 103 of biasing the second processing member 102 toward the first processing member 101 is interposed between the upper face of the second processing member 102 (the other side the processing face 120) and the top face 124*a* or the bottom end of the receiving recess 124. That is, the springs 130 . . . 130 function to press the upper face of the processing face 120 so as to bias the second processing member 102 (downward) toward the first processing member 101 side. Provision of the springs 130 . . . 130 is made uniform over the top face 124*a* of the receiving portion 124.

For the biasing mechanism 103, a single spring may be used instead of a plurality of springs, with its diameter being stronger than the inner diameter of the second processing member 102 and smaller than the outer diameter of the second processing member 102. The purpose of the provision of the biasing mechanism 103 is to produce a uniform force regularly to the second processing member 102, so it is not restricted to springs.

That is, referring to the biasing mechanism 103, other biasing means using fluid pressure such as air may be employed instead of, or together with said spring 130.

More specifically, as in FIG. 10, a high-pressure air inlet 132 may be used as part of the biasing mechanism 103 for adjusting the biasing force. In this case, the biasing mechanism 103 may be constituted of the high-pressure air inlet 132 alone, or of the spring 130 and the high-pressure air inlet 132, as shown in FIG. 10.

As shown in FIG. 11, since the inner diameter of the receiving recess 124 is stronger than the outer diameter of the second processing member 102, a clearance t1 appears between the outer periphery 102*b* of the second processing member 102 and the inner periphery of the receiving recess 124, when in alignment.

Likewise, there is provided a clearance t2 between the inner periphery 102*a* of the second processing member 102 and the outer periphery of the center portion of the receiving recess 124.

Said clearances t1, t2 are intended for absorbing vibration or eccentric behavior. They are made stronger enough to secure both working range and sealing ability. For example, it is preferable that with the diameter of the first processing member 101 being within the range of 100 to 400 mm, said clearances t1, t2 be set to 0.1 to 0.3 mm in width.

The first holder 111 is fixed integral to the shaft 150 along with the first processing member 101 in a manner to rotate together with the shaft 150. Projections 125, 127 prevent the second processing member 102 from rotating together with the second holder 121 even by the aid of the annular element 123. However, as shown in FIG. 13(B), a clearance t3 is established between the top portion 124*a* (the bottom portion) of the receiving recess 124 and the upper face of the annular element 123 opposite to said top portion 124*a* in order to guarantee a width which is required between 0.1 to 1.0 micron for atomizing processing. Regarding provision of said clearance t3, said clearances and the vibration or extension of the shaft 150 should be taken into consideration.

Installation of the clearances t1 to t3 permits the first processing member 101 to move to or away from the second processing member 102, and enables the processing face 110 to change its center or rotation (regarding directions z1, z2).

That is, in this embodiment, the biasing mechanism 103 and said clearances t1 to t3 constitute a floating mechanism, which at least allows the center or inclination of the second processing member 102 to move by several microns to several millimeters. This may absorb a run-out and expansion of the rotary shaft, and a face run-out and vibration of the first processing member 101.

Allowance between the projection or stopper 125 and the recess 122 and between the projection or stopper 127 and the recess 126 assures said floating mechanism in the second processing member 102 of its operation, whereby these stoppers will never hinder said operation.

Said grooves 122 as formed in the grinding face 110 of the first processing member 101 will be further described. Each of the grooves 112 reaches the inner periphery 101*a* of the first processing member 101 at the rear end thereof while stretching its leading end toward the outside y (outer periphery side) of the first processing member 101. FIG. 12(A) illustrates that the groove 112 becomes smaller in its cross sectional area gradually from the center x of the annular first processing member 101 to the outside y (outer periphery side) of the first processing member 101.

The width w1 between the right and left side faces 112*a*, 112*b* of the groove 112 becomes shorter from the center x of the first processing member 105 toward the outside y (outer periphery side) of the first processing member 101. And so is the depth w2 thereof. That is, the bottom 112*c* of the groove 112 becomes shallower as it proceeds from the center x of the first processing member 101 to the outside y (outer periphery side) of the first processing member 101.

In this way, the cross sectional area of the groove 112 is rendered gradually smaller toward the outside y (outer periphery) as the width and depth of the groove 112 become gradually reduced toward the outside y with the leading end thereof (at y side) dead-end. That is, beyond the groove 112 there remains an outer flat face 113 in the processing face 110 between the leading end of the groove 112 and the outer peripheral face 101*b* of the first processing member 101.

In the present embodiment, the right and left side faces 112*a*, 112*b* and the bottom 112*c* constitutes a flow limiting portion. The flow limiting portion, a flat portion lying around the groove 112 of the first processing member 101, a flat portion of the second processing member 102 are combined into a dynamic pressure generating mechanism 104.

However, such a variation is available that the reduction of cross sectional area is performed by one of the width and depth of the groove 112 as formed with said arrangement. In this instance, the right and left side faces 112*a*, 112*b* or the bottom 112*c*, neither of which employing said arrangement, provides no flow limiting portion or component of the dynamic pressure generating mechanism 104.

Said dynamic pressure generating mechanism 104 may produce a force to urge the processing members 101, 102 into separation, thereby reliably obtaining a desired micro-scale interval between the processing members 101, 102 by the medium of fluid flowing between the processing members 101, 102 in operation. Such a dynamic pressure enables the interval between the processing face 110, 120 between 0.1 to 1.0 micron. The micro-scale interval may be selected by the adjustment in accordance to the natures of the substance to be processed. Preferably it is 1 to 6 microns, and more preferably 1 to 2 microns. This specific deaerator is capable of removing finer bubbles such a narrow interval, which was impossible with the conventional art.

The grooves 112 . . . 112 are usable even if they are of a type of extending straight from the center x to the outside y. However, as shown in FIG. 12(A), the groove 112 stretches itself from the center x side to its leading end 113 in the direction of rotation r of the first processing member 101, to such an extent that the center x side of the groove 112 is positioned ahead of its leading end 113 in view of the direction of rotation r The extension of the grooves 112 . . . 112 in a curve may ensure more effective separation force by the dynamic pressure generating mechanism 104.

The description of the deaerator is as follows.

Fluid R, a substance to be processed, is supplied into the hopper 170 through the introducing portion 107. Passing through the hollow portion of the annular second processing member 102, the fluid travels between the processing members 101, 102 after it has received a centrifugal force resulting from the rotation of the first processing member 101. Then, the fluid R is subjected to atomizing process between the processing face 110 of the first processing member 101 in rotation and the processing face 120 of the second processing member 102, leaving the processing members 101, 102, and being discharged out to the vacuum pump Q via the discharge portion 108.

To be more specific, as shown by FIG. 3(A), the fluid R from the hollow portion of the second annular processing member 102 at first enters the grooves 112 of the first processing member 101 in motion, while the planished (flat) processing faces 110, 120 are kept closed against gas such as air, nitrogen and the like. Consequently, the fluid under a centrifugal force is prevented from sneaking in between the processing faces 110, 120 which have been brought into a closed contact with each other by the biasing mechanism 103. However, the fluid hits both the faces 112*a*, 112*b* and the bottoms 112*c* of the grooves 112 formed as flow limiting portion and generate dynamic pressure which may force the processing faces 110, 120 into separation. This may help the fluid flow out on the flat faces, ensuring that a micro-scale interval of the clearance will be formed between the processing faces 110, 120. Then, atomization takes place between the planished flat portions. The curved configuration of the groove 112 may make the centrifugal force act on the fluid R more reliably so as to generate said dynamic pressure more effectively.

This particular deaerator makes it possible to acquire a micro-scale clearance between the planished faces (processing faces 110, 120) by holding the balance between the dynamic pressure and the biasing mechanism 103, which may reduce the clearance under 1 micron.

The provision of the floating mechanism leads to the automatic adjustment of alignment between the processing faces 110, 120, thereby enabling maintenance of any possible variation of the clearance in each position between the processing faces 110, 120 in respect of the physical deformation of different parts of the processing faces due to rotation or heat rise for a reliable maintenance of said micro-scale clearances in the different positions.

In the above embodiment, the floating mechanism is provided only in the second holder 121. It may be mounted on the first holder 111 instead of the second holder 121, or on both holders 111, 121.

Other embodiments of said groove 112 are shown in FIGS. 14 to 16.

As shown in FIGS. 14(A),(B), the groove 112 may have a flat wall face 112*d* as a flow limiting portion formed in the leading end thereof. The embodiment as per FIG. 14 is provided with a step 112*e* constituting part of the flow limiting portion between the first wall face 112*d* and the inner peripheral face 102*a*.

As shown in FIGS. 15(A),(B), the groove 112 includes a plurality of branches 112*f* . . . 112*f*, each of which width becomes gradually shorter toward the leading end, so that the groove 112 may serve as a flow limiting portion.

The embodiments as per FIGS. 14 and 15 are identical to the embodiment of FIGS. 10 to 13 in the arrangements except for the above-described.

The flow limiting portion in the above embodiments has a structure of the groove 112 gradually reducing the size of at least either its width or depth from the central portion of the first processing member 101 toward the outer periphery. Additionally, as shown in FIGS. 16(A),(B), the end faces 112*f* provided in the groove 112 with uniform width and depth therein can be referred to a flow limiting portion. As described so far and shown in FIGS. 12, 14 and 15, change of the width and depth of the groove 112 to have a slope on the bottom and the both cross sectional sides thereof may let the bottom and the both sides of the groove 112 serve as a pressure receiving portion for origin of dynamic pressure. Meanwhile, in the embodiments as shown in FIGS. 16(A)(B), the end face of the groove 112 performs a pressure receiving portion against fluid to be processed to generate dynamic pressure.

In the above case, one of the dimension of width and depth of the groove 112 may be gradually shorter.

The arrangements of the grooves 112 are not limited to those in FIGS. 12, 14 to 16. So a flow limiting portion is different configuration is also available.

For example, FIGS. 14 to 16 show the leading end of the grooves 112 does not reach the outside the first processing member 101. That is, there is an outer flat face 113 between the outer peripheral face of the first processing member 101 and the groove 112. However, any configuration of the groove 112 is applicable as long as the arrangement allows generation of said dynamic pressure, meaning whether the groove 112 reaches the outer peripheral face of the first processing member 101 or not.

For example, in the case of the first processing member 101 as per FIG. 16(B), a section shown by a dotted line and having a smaller cross sectional area than that of the other site of the groove may be formed in the outer flat face 113.

Not shown, though, the cross sectional area of the groove 112 may be made gradually smaller from the central portion toward the outer periphery as described, and such a portion (end portion) of the groove 112 in the outer periphery of the first processing member 101 may have the smallest cross sectional area. However, with the aim of effective generation of dynamic pressure, it is preferable that the groove 112 be not of a type extending beyond the outer peripheral face side of the first processing member 101, as shown in FIGS. 12, 14 to 16.

Only the first processing member 101 in accordance with above-described embodiments is rotatable and the second processing member 102 is not, variation may be employed such that both the processing members 101, 102 are of a rotational type. In this event, the second processing member 102 should be so arranged as to rotate in the direction opposite to the direction r in which the first processing member 101 rotates.

For example, as shown in FIG. 17, in addition to the aforementioned drive 105, another drive 105*a* with a shaft 150*a* to rotate the second holder 121 may be mounted formed independent from the housing 106. In this case, the shaft 150*a* of the drive 105*a* is made hollow, and the inside thereof provides an introducing portion 107.

With the deaerator as per FIG. 17, the second holder 121 is provided with the floating mechanism as in the deaerator as per FIGS. 10 and 11. An arrangement is also available that the floating mechanism is mounted on the first holder 111 instead of the second holder 121, or on both of the holders 111 and 121.

The embodiments as shown in FIGS. 10 to 17 will be put together in the following.

The deaerator comprising a rotatable member having a flat processing face and a stationary member having a flat processing face likewise, both members being concentrically opposite to each other, wherein a substance to be processed is fed from the opening of the stationary member while the rotatable member in motion in the course of atomization between the opposite flat processing faces of both the members, may considerably improve atomization by maintaining the clearance therebetween under pressure generated by a pressurization mechanism provided in the rotatable member, not by adjusting the clearance mechanically, and thus achieving a micro-scale clearance of 1 to 6 microns which were unachievable by the mechanical control system.

That is, it is a high-speed rotary deaerator wherein the rotatable member and the stationary member have on the outer peripheries thereof a flat face, between which are generated hydrostatic and hydrodynamic powers or aerostatic and aerodynamic powers by virtue of the sealing ability attained by the faces. Said powers can create a slight clearance between said sealed faces so that safe and highly precise non-contact atomization may be carried out in a mechanical manner. Of all the factors causing the formation of such a slight clearance, one is the rotary speed of the rotatable member, and another the difference of the pressure between the introducing side of and discharging side of the substance (fluid) to be processed. If the pressure applying mechanism is not installed at the introducing side, i.e. a substance to be processed (fluid) is supplied under the atmospheric pressure, no difference of pressure occurs. Therefore, the sealed faces need to separate from each other by means of only the rotary speed of the rotatable member. This is known as hydrodynamic or aerodynamic power.

Though FIG. 10 shows the vacuum pump Q connected with the discharge portion of said atomizing apparatus G, without the housing 106 (casing 3) and vacuum pump Q as well, as described already, the deaerator is used as a decompression tank T, and the atomizing apparatus G may be disposed within said tank T, as shown in FIG. 18(A).

In this event, by vacuumizing or decompressing the tank T into a condition close to a vacuum, the atomized substance by the atomizing apparatus G is sprayed into the tank T. Some of the sprayed substance may contact the inner wall of the tank T, going down and being recovered, or some may be separated from said recovered substance in the form of gas (steam) to fill up the tank T in the upper portion and be recovered, thereby obtaining the processed and specified substance.

In the provision of the vacuum pump Q, as per FIG. 18(B), the atomizing apparatus G is connected with the air-tight tank T via the vacuum pump Q, and the atomized substance is sprayed in the tank T to ensure that the intended objects will be separated (extracted).

Furthermore, as shown in FIG. 18(C), a direct connection of the tank T, which connects the atomizing apparatus G, with a discharge portion of the fluid R different from the vacuum pump Q may achieve separation of the specific object. In this case, the vaporized portion is vacuumed up by the vacuum pump Q, and liquid R (liquid portion) is discharged at the discharge portion.

An atomizing apparatus G in accordance with the embodiments as shown in FIGS. 1 to 18 is intended to be used with the deaerator. However, the atomizing apparatus G may be used independent from the deaerator as a dispersion and emulsification unit for dispersion, emulsification, mixture, or an attrition unit for grinding or attrition.

The processing apparatus for fluid in accordance with the first to thirteenth aspects of the present invention is the most suitable apparatus for said dispersion and emulsification, and the processing apparatus for fluid in accordance with the fourteenth to eighteenth aspects of the present invention for said attrition.

For use of the atomizing apparatus for dispersion, emulsification and mixing, as shown in FIG. 7, provision of the feed passage 28 admitting to the second processing face 2 mounted on the second processing portion 20 in addition to the introducing portion 22 is effective, so that a different substance or part of fluid to be processed may be directly supplied into the fluid to be processed through said feed passage 28. This arrangement is very useful for avoiding pre-dispersion or handling a highly reactive fluid to be processed.

If the atomizing apparatus is used for grinding or attrition, the first processing member 101 as per FIGS. 10 to 13 acts as a first grinding member (the first grinding member 101), and the second processing member 102 as a second grinding member (the second grinding member 102). Namely, the first and second grinding members 101, 102 are respectively an annular element having a hollow portion in the middle of a column, and at the bottom thereof is respectively constitute a grinding faces 110, 120 which may serve as whetstones.

The first to thirteenth aspects of the present invention provides a processing apparatus for fluid and the relating processing method, wherein inclusion of impurity can be avoided; a wide range of fluid to be processed in applicable degree of viscosity can be handled; a great shear force can be imparted to the fluid to be processed; high precise dispersion, emulsification, mixture, grinding, attrition be achieved.

That is, by employing the mechanical seal mechanism as means for dispersion and emulsification, the processing apparatus of a simple structure and a high productivity which is capable of high precise dispersion, emulsification, mixture, grinding, attrition and the relating processing method is provided.

Said embodiments of the present invention make it possible to adjust thickness of fluid film from the fineness, with immunity from restriction of the range of viscosity of the fluid to be processed thanks to the lead-in pressure (fluid pressure) of fluid to be processed and the back pressure of the compression ring (the second processing portion), thereby enabling dispersion of super fine particles of the order of scores of nanometers, which was unavailable in the past, and obtaining a high degree of dispersion free from impurity because of the provision of a buffer system for controlling small vibrations, alignment, or axial displacement. Comprising a simple structure, the apparatus does not require a skill or proficiency, being able to employ an unmanned or automate operation, ensuring a high productivity and constant production, and a low-cost manufacturing.

The processing apparatus and the relating processing methods in accordance with the first to thirteenth aspect of the inventions are especially suitable for dispersion and emulsification.

The fourteenth to eighteenth aspects of the present invention achieve the clearance between both processing faces (or two pieces of whetstones laid one upon another) under 15 microns in grinding fluid to be processed or supplying a substance to be processed into the fluid being processed. That is to say, a super-fine grinding which is indispensable for the recent development of nanotechnology has been put into realization. A high-performance grinder (atomizer) which may avoid inclusion of impurity and rotate at a high speed is provided by the present invention.

The nineteenth to twenty-second aspects of the present invention may eliminate the conventional punching plates and meshes for atomization so as to avoid cleaning of said members and enable extraction (exclusion) of fine bubbles which are unable by means of the punching plate and mesh.

In particular, in case a substance to be processed is fluid, or a substance to be processed is supplied into the fluid being processed, a clearance under 15 microns is successfully achieved between two members (processing members) laid one upon another.

Additionally, said aspects of the present invention provide the deaerator, which comprises a simple structure, high productivity, and is capable of high precise atomization, wherein any inclusion of impurity can be prevented, and a wide range of fluid in the applicable degree of viscosity can be handled.

That is, by employing the mechanical seal mechanism as means of atomization, the processing system of high productivity and simple structure and the processing method could have been provided. In particular, said inventions of the present application make it possible to control the thickness of fluid film from the fineness with immunity from restriction of the range of viscosity of the fluid to be processed thanks to the lead-in pressure (fluid pressure) of fluid to be processed, back pressure of the compression ring (the second processing portion) and the rotation of the mating ring (the first processing portion), thereby enabling automation of the order of several nanometers, which was unavailable in the past, and obtaining a high degree of atomization free from impurity because of the provision of a buffer system for controlling small vibrations, alignment, or axial displacement. Being of a simple design, the system requires no skill or man's hands, being easy of automation, operable in a stable manner, ensuring a high productivity, and producible at a low cost.

Figure 1:
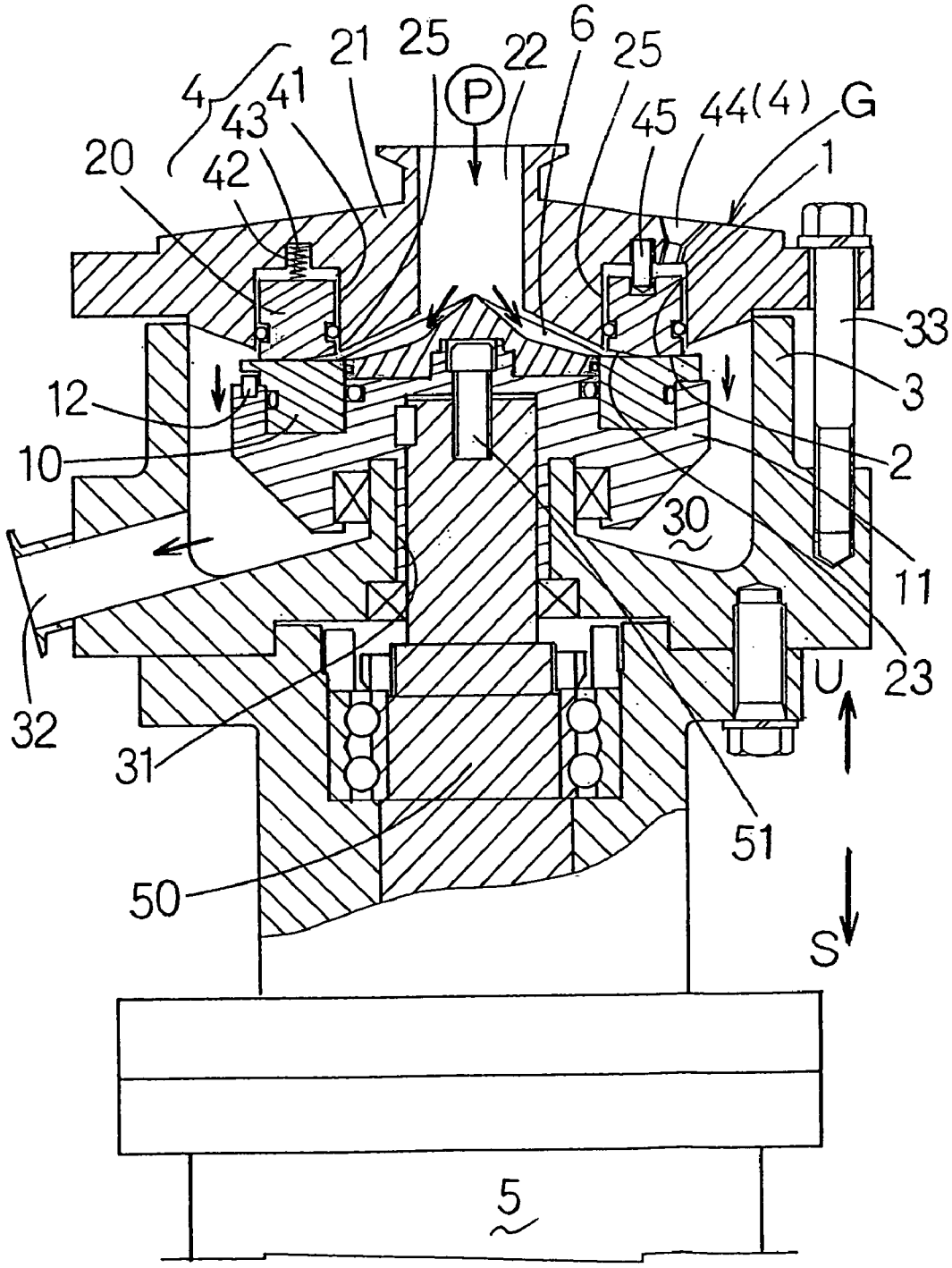
FIG. 1 is a partially cutaway longitudinal sectional view of a apparatus in accordance with one embodiment of the present invention.
Figure 2B:
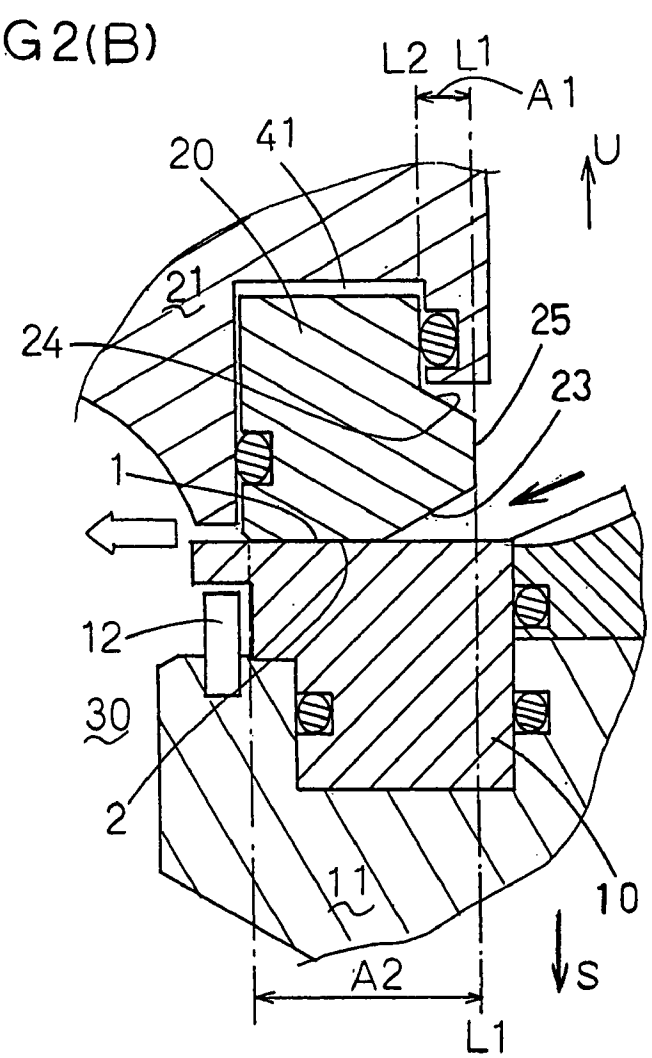
FIG. 2 is a longitudinal sectional view showing the main part (A) of said apparatus, and (B) of another embodiment, FIGS. 3(A),(B),(C) are longitudinal sectional views of the main part of further embodiment, FIGS. 4.5 are longitudinal sectional views of further embodiments, FIGS. 6(A), (B), (C) and (E) are cross sectional views showing the main part of further embodiments, and (D) a longitudinal sectional view showing a partially cutaway main part of further embodiment.
Figure 2A:
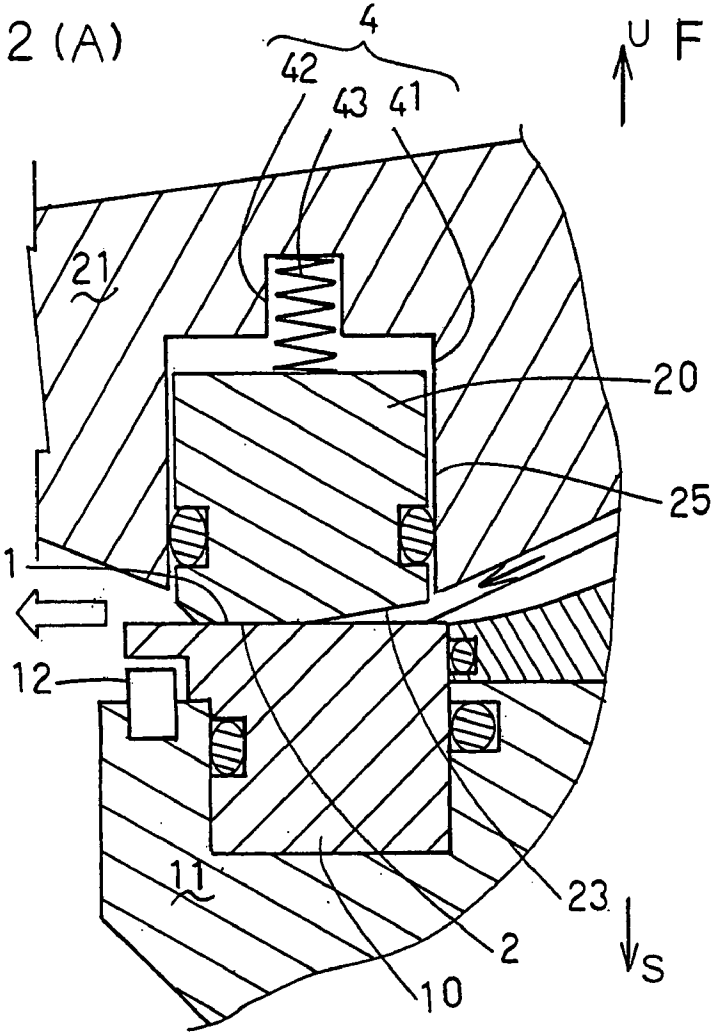
Figure 3:
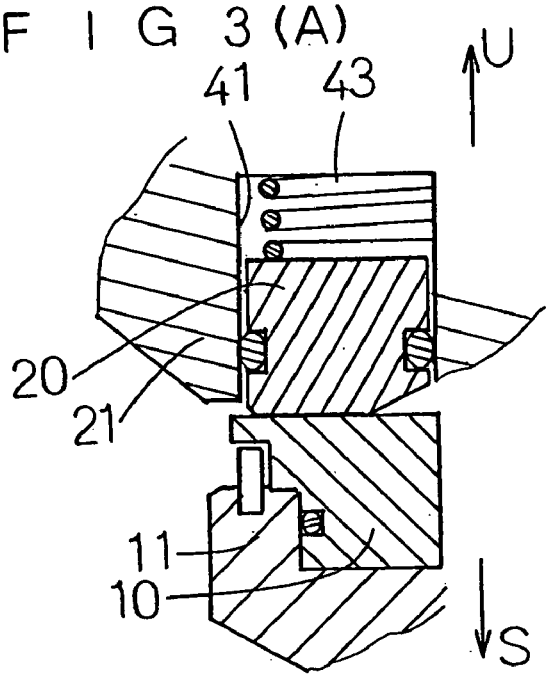
Figure 3:
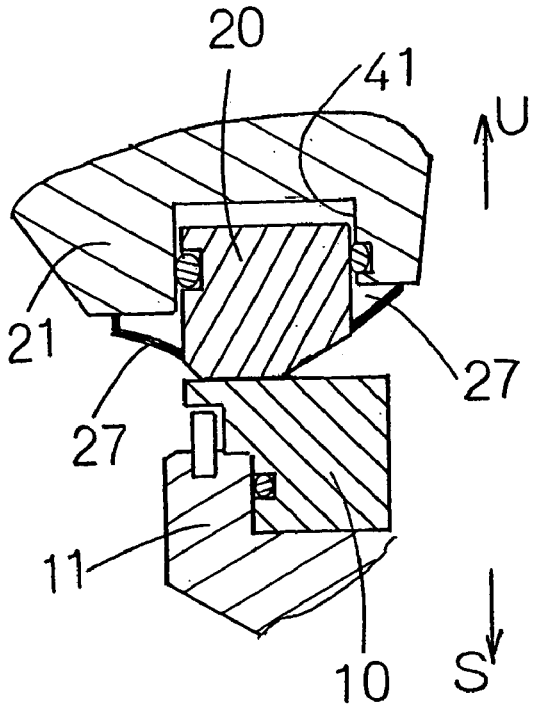
Figure 3:
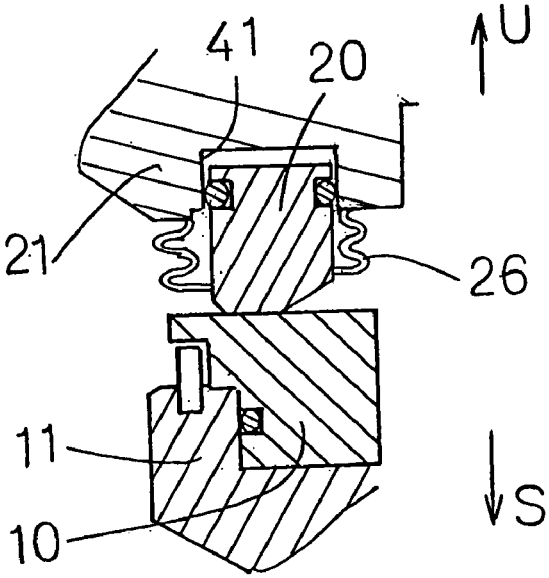
Figure 4:
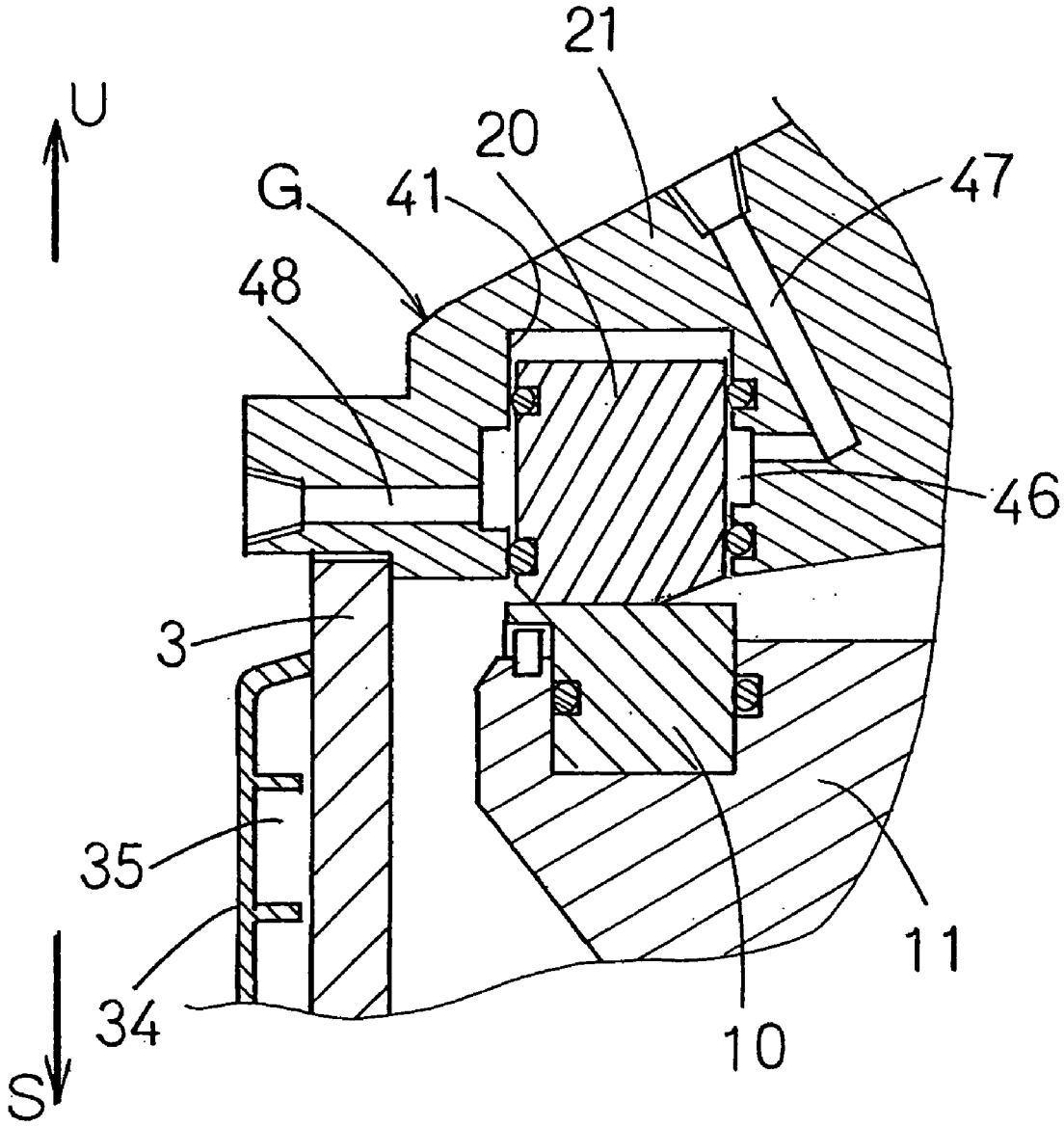
Figure 5:
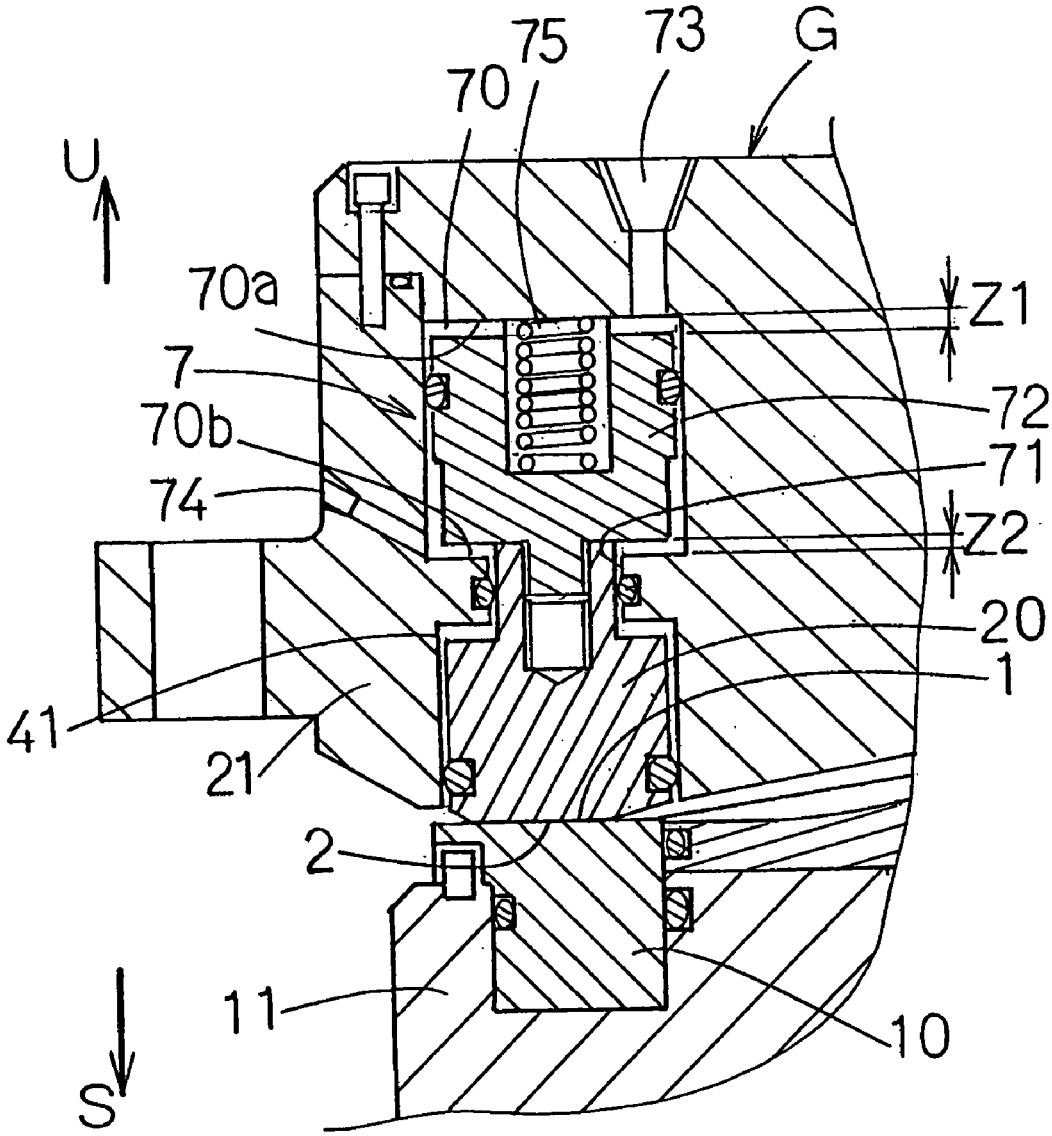
Figure 6:
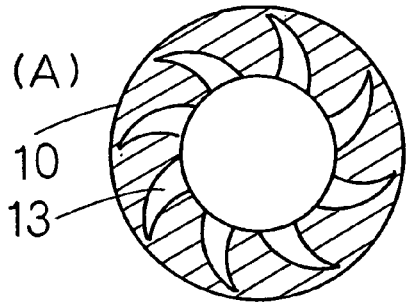
Figure 6:
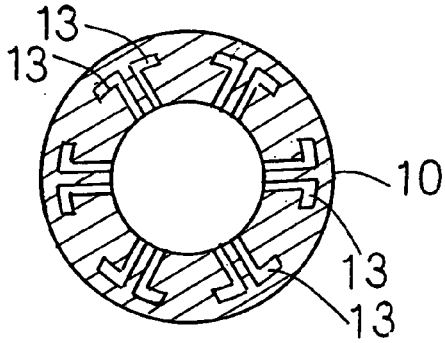
Figure 6:
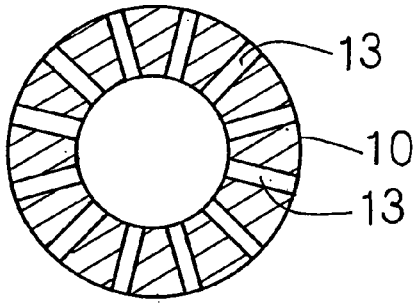
Figure 6:
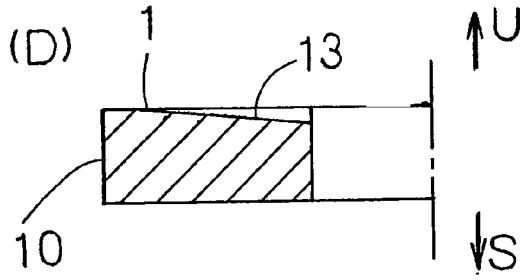
Figure 6:
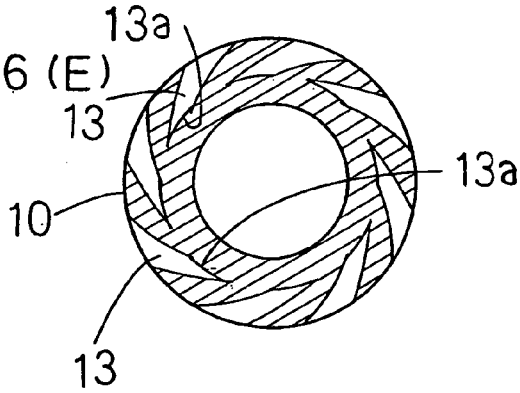
Figure 7:
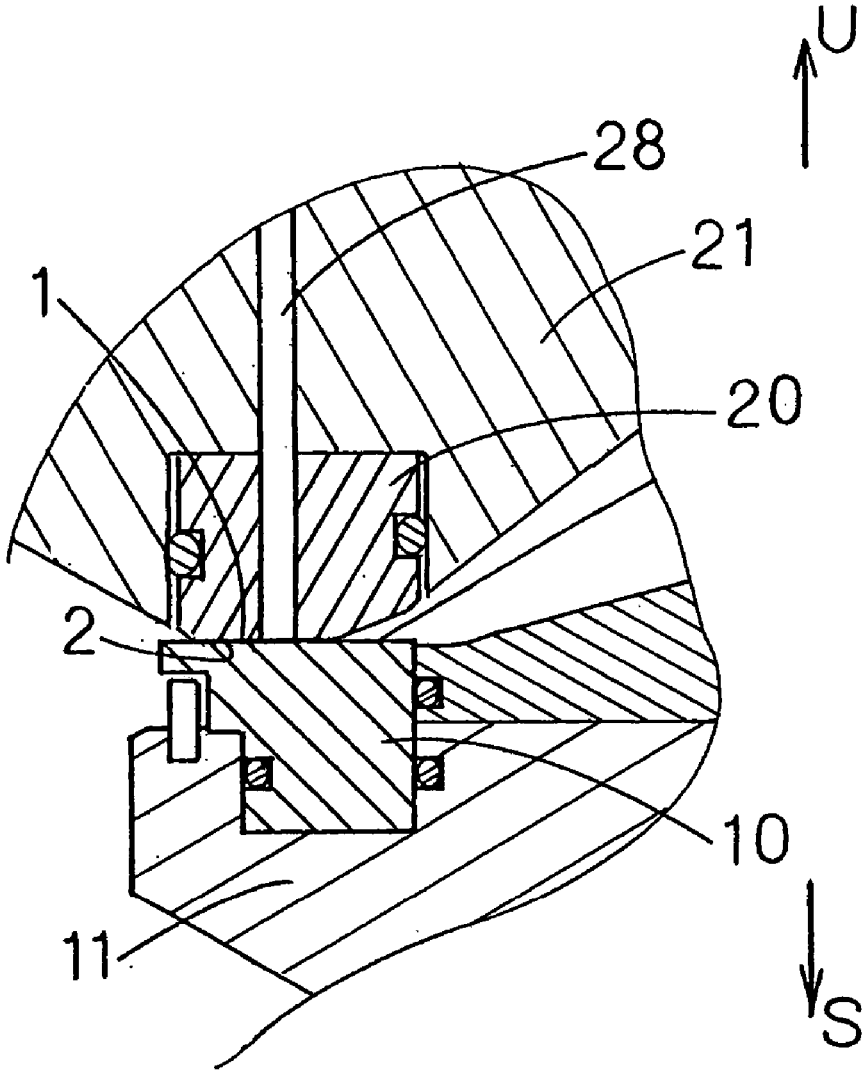
FIG. 7 is a longitudinal sectional view showing the main part of further embodiment.
Figure 8:
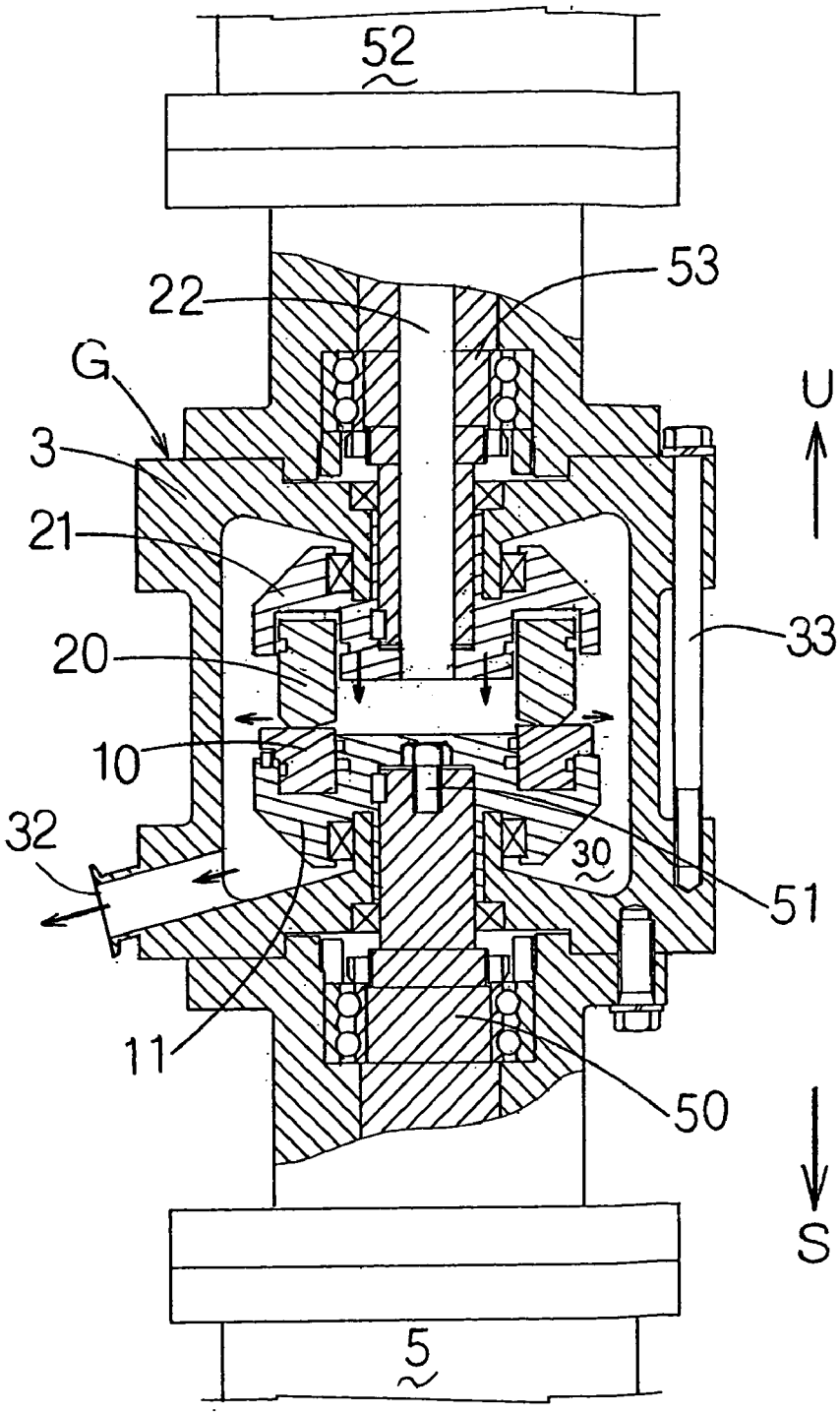
FIG. 8 is a longitudinal sectional view of another embodiment.
Figure 9:
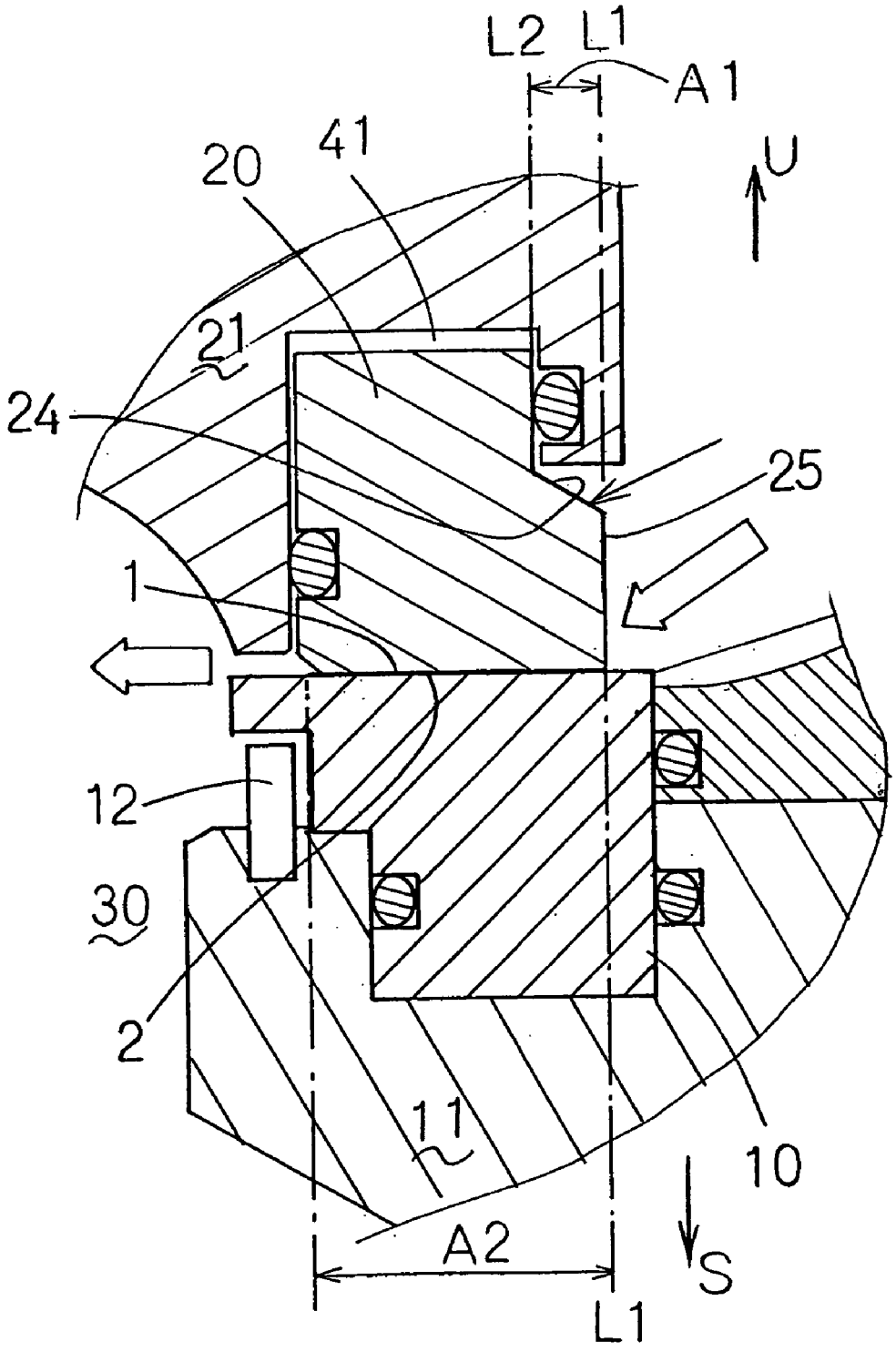
FIG. 9 is a longitudinal sectional view of showing the main part of further embodiment.
Figure 10:
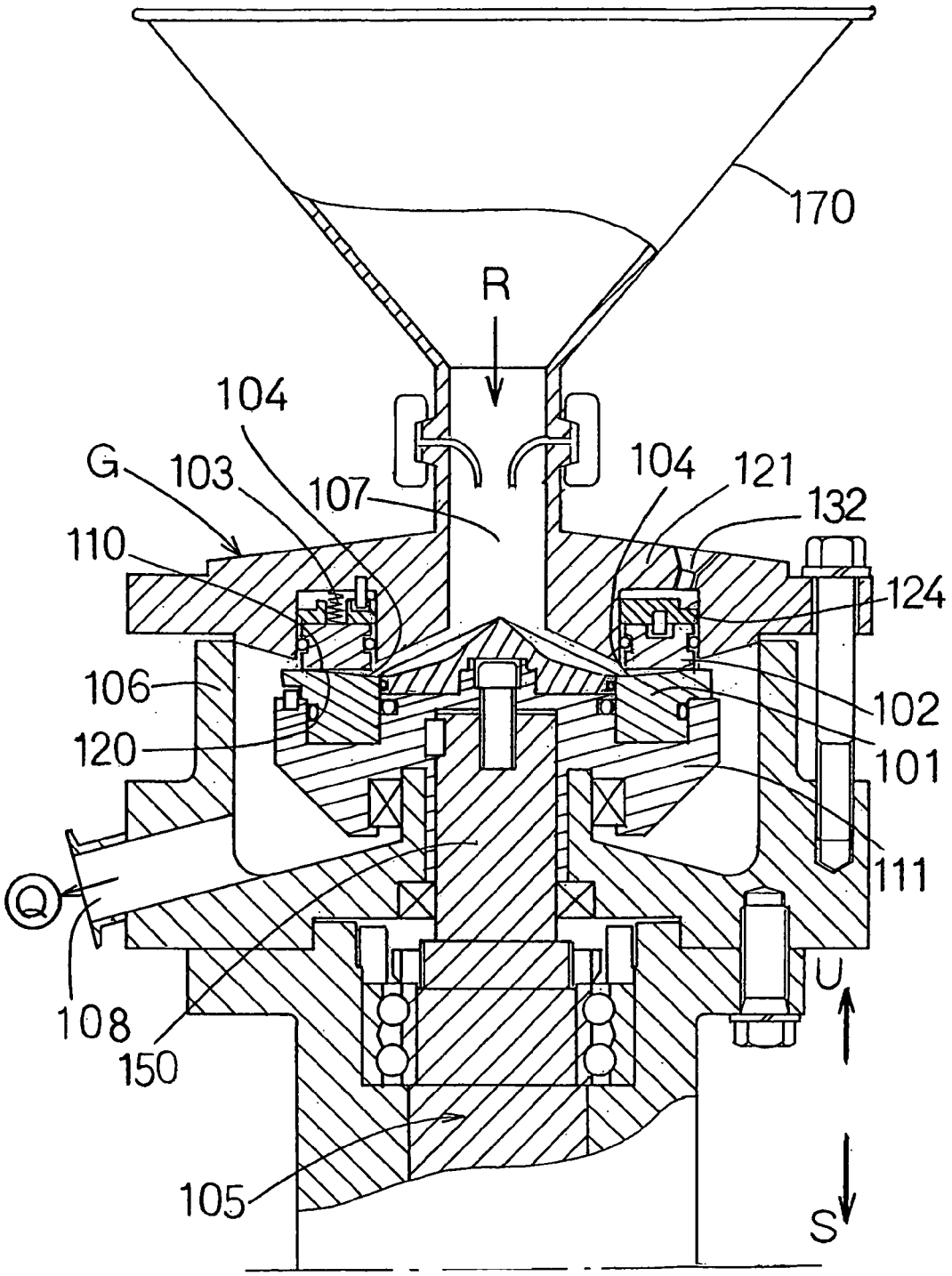
FIG. 10 is a partially cutaway longitudinal sectional view of a deaerator in accordance with another embodiment.
Figure 11:
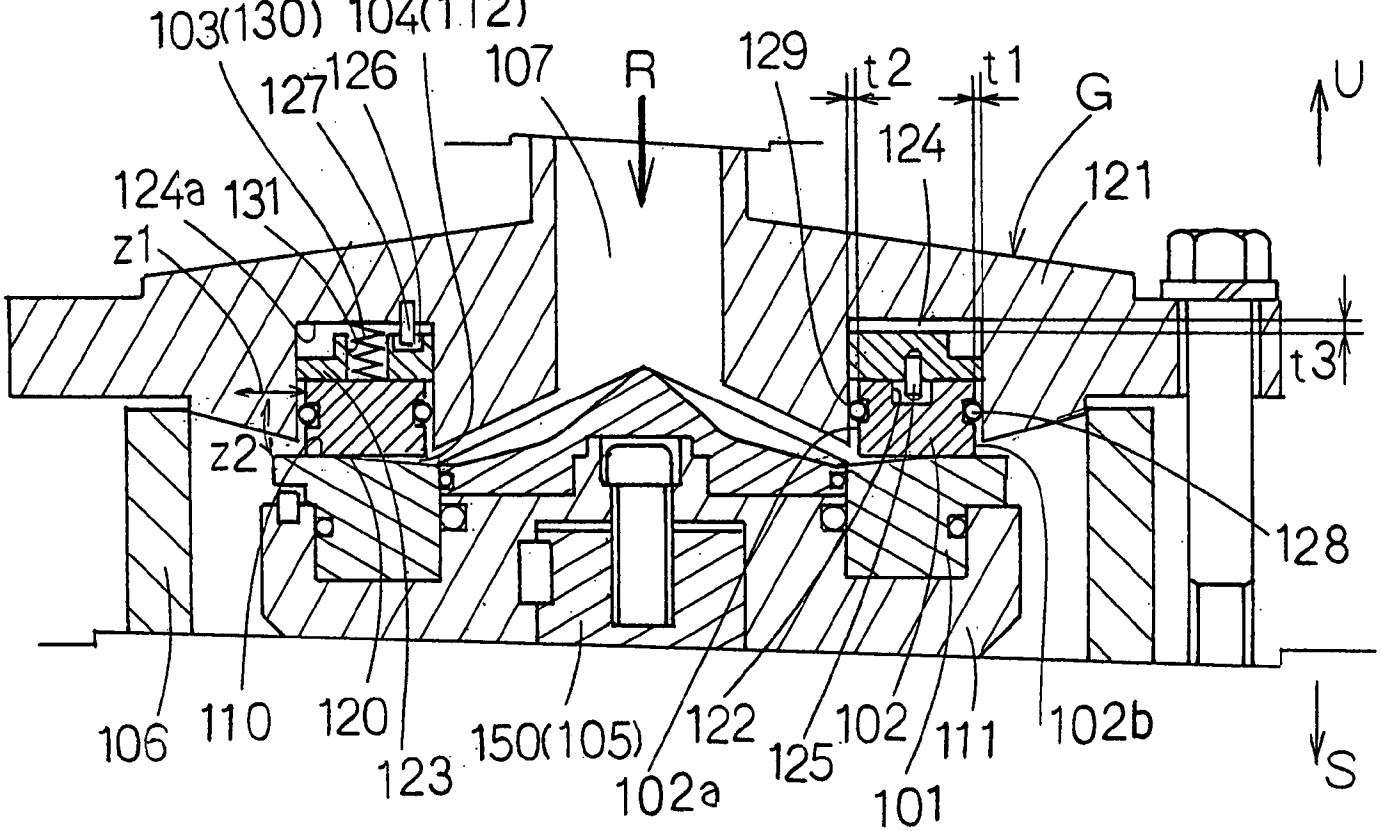
FIG. 11 is a longitudinal sectional view showing the main part consisting of a first processing member 1 and a first holder 11 of the deaerator of FIG. 10.
Figure 12A:
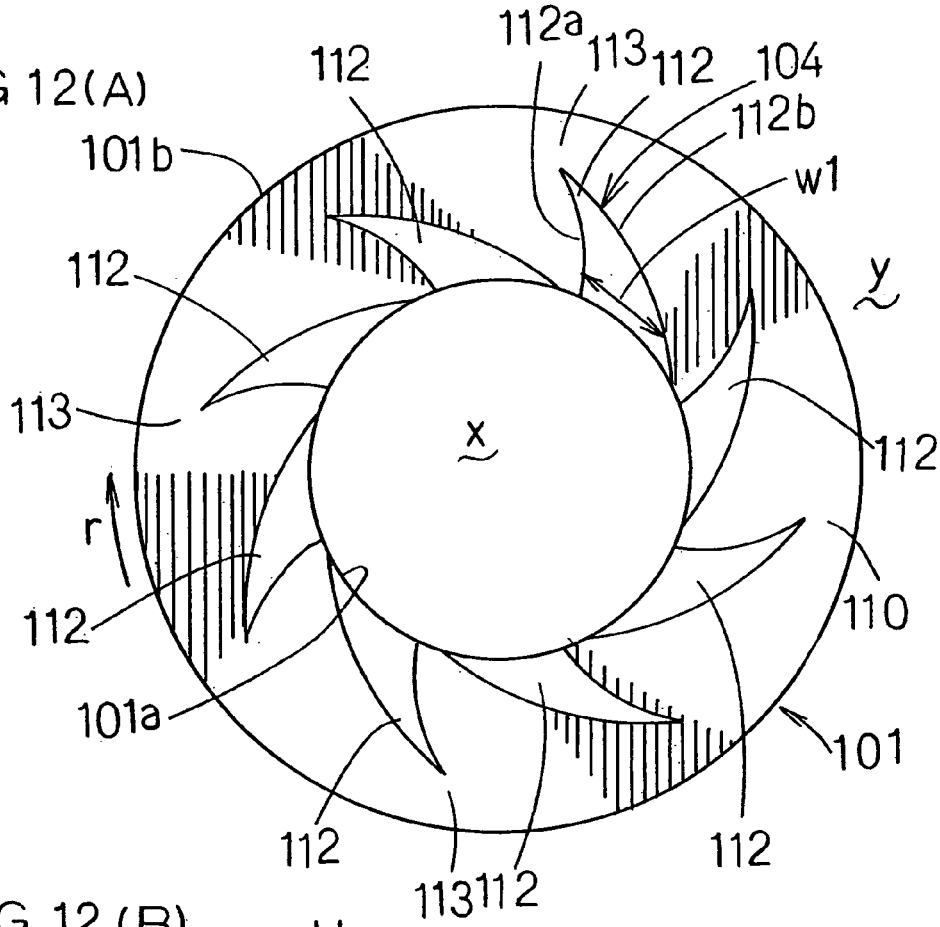
FIG. 12 is a view of the first processing member 1 of said deaerator of FIG. 10, (A) a plan view, and (B) a longitudinal sectional view showing its main part.
Figure 12B:
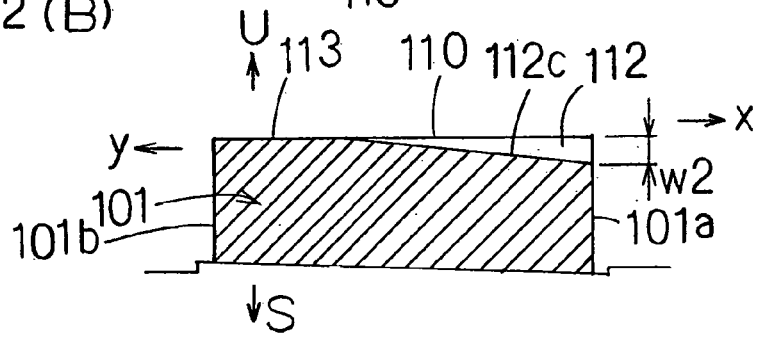
Figure 13A:
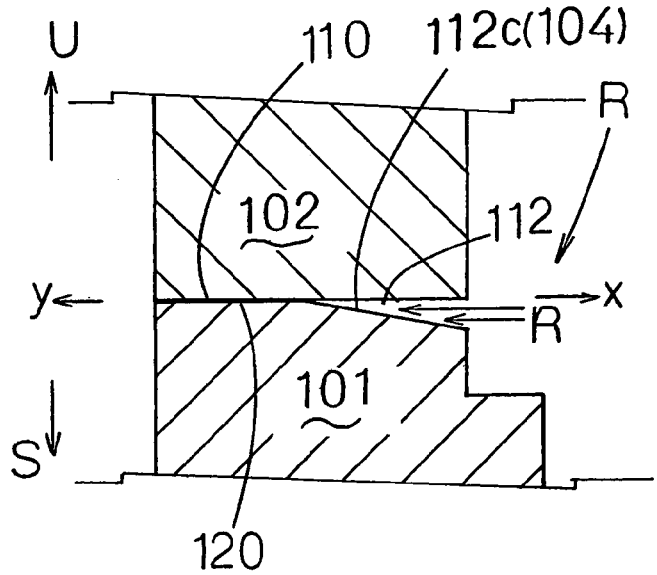
FIG. 13 is a longitudinal sectional view showing the main parts of the first and second processing members 1, 2 of the deaerator of FIG. 10, (A) without a micro-scale interval of the clearance between said members and (B) with a micro-scale interval of the clearance therebetween.
Figure 13B:
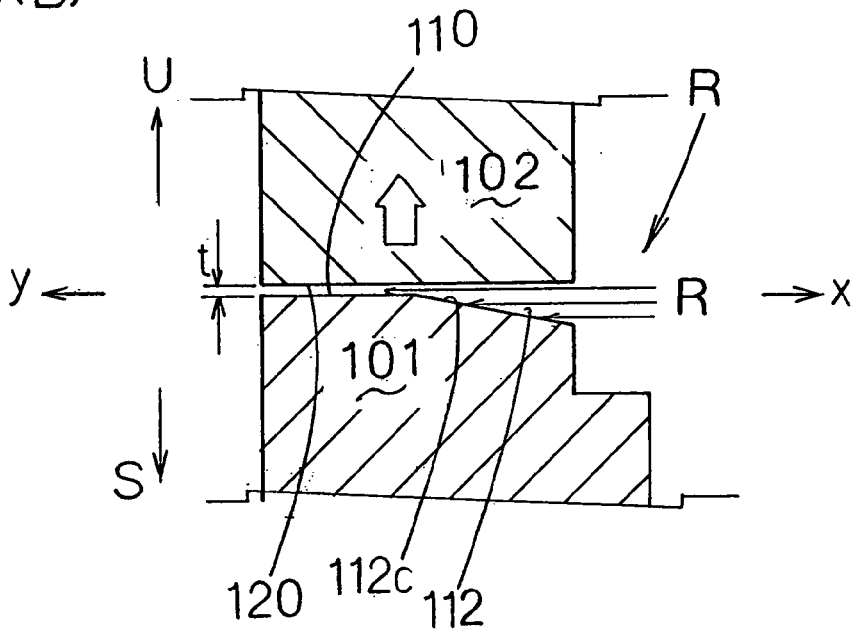
Figure 14A:
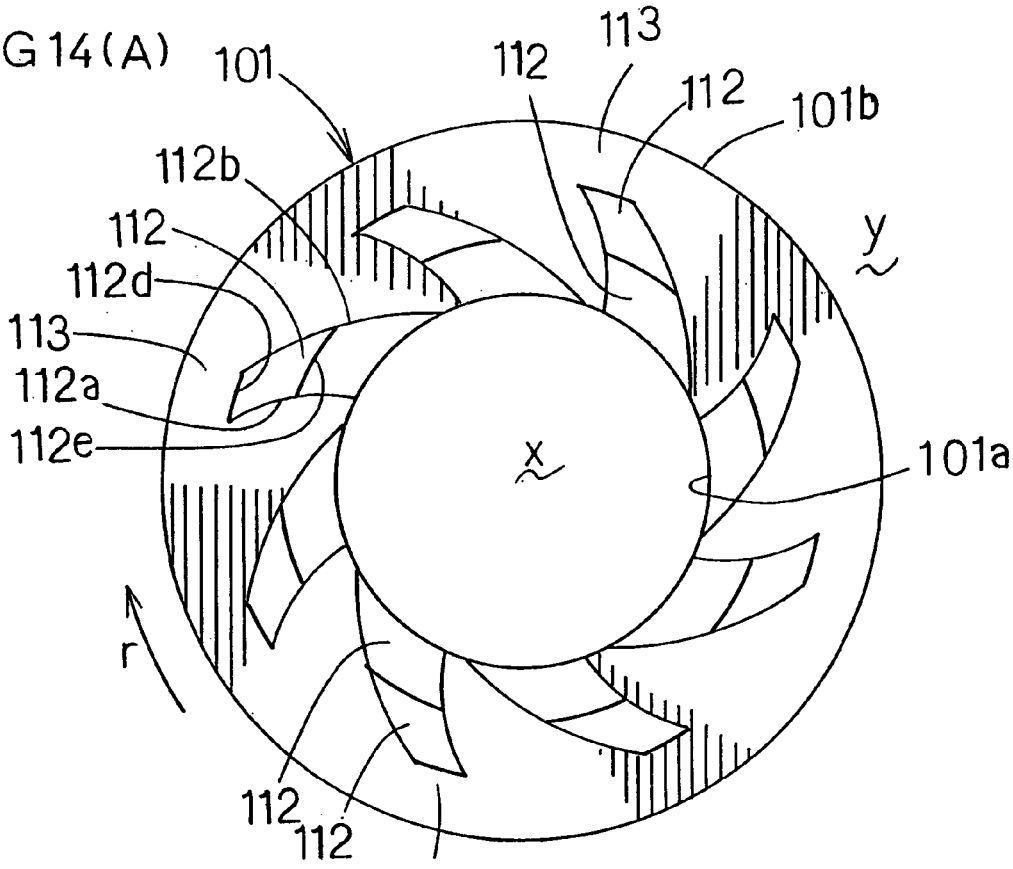
FIG. 14 is a view of another embodiment of the first processing member 1, (A) a plan view and (B) a longitudinal sectional view of its main part.
Figure 14B:
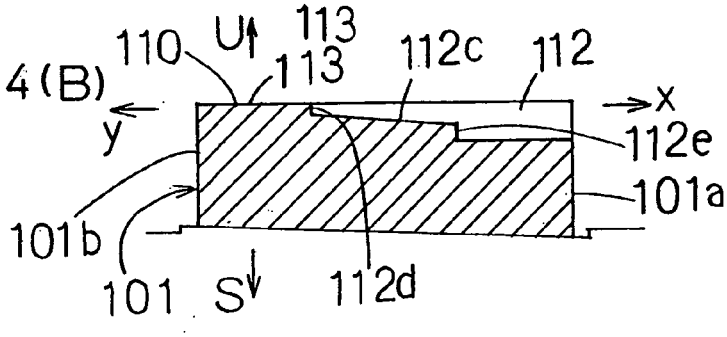
Figure 15A:
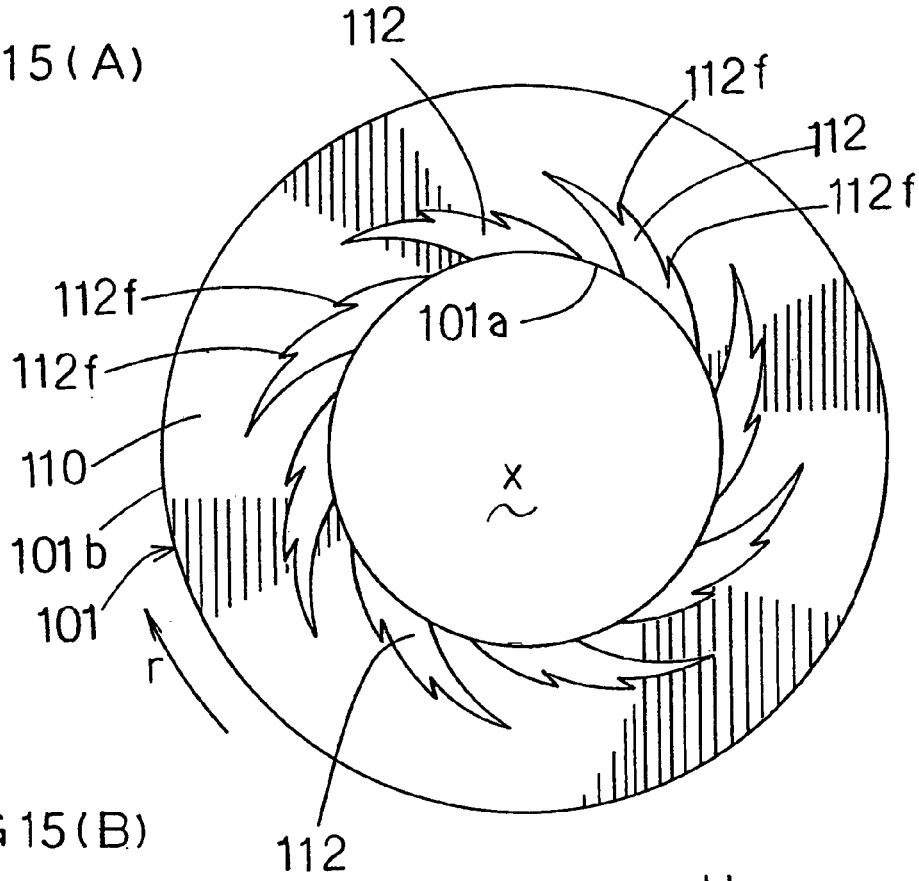
FIG. 15 is a view of further embodiment of the first processing member 1. (A) a plan view and (B) a longitudinal sectional view of its main part.
Figure 15B:
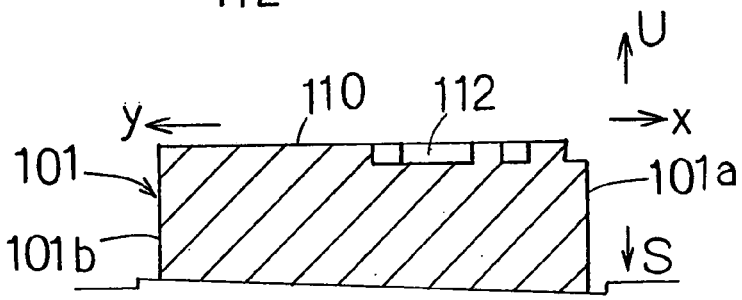
Figure 16:
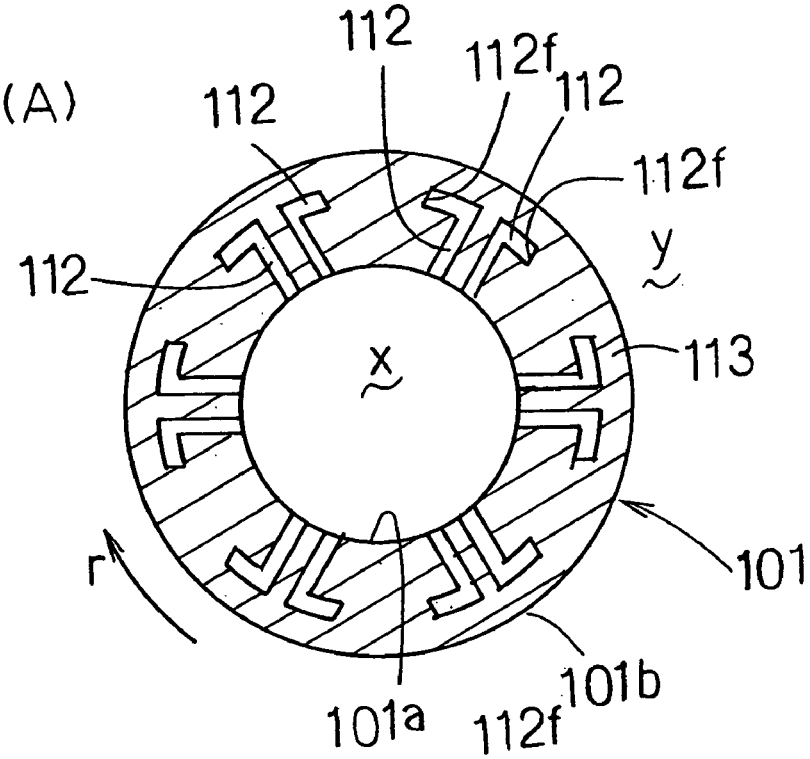
FIGS. 16(A) and (B) are respectively plan views of further embodiments of the first processing member 1.
Figure 16:
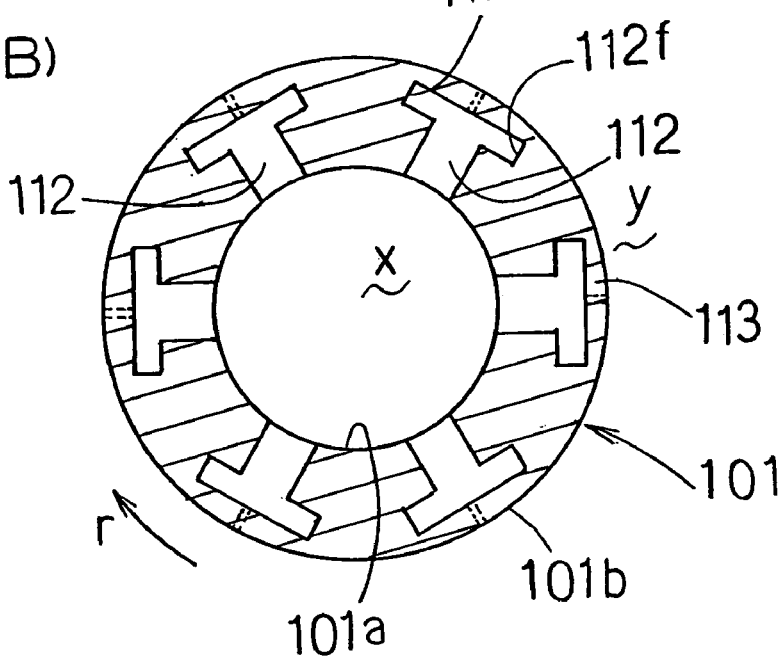
Figure 17:
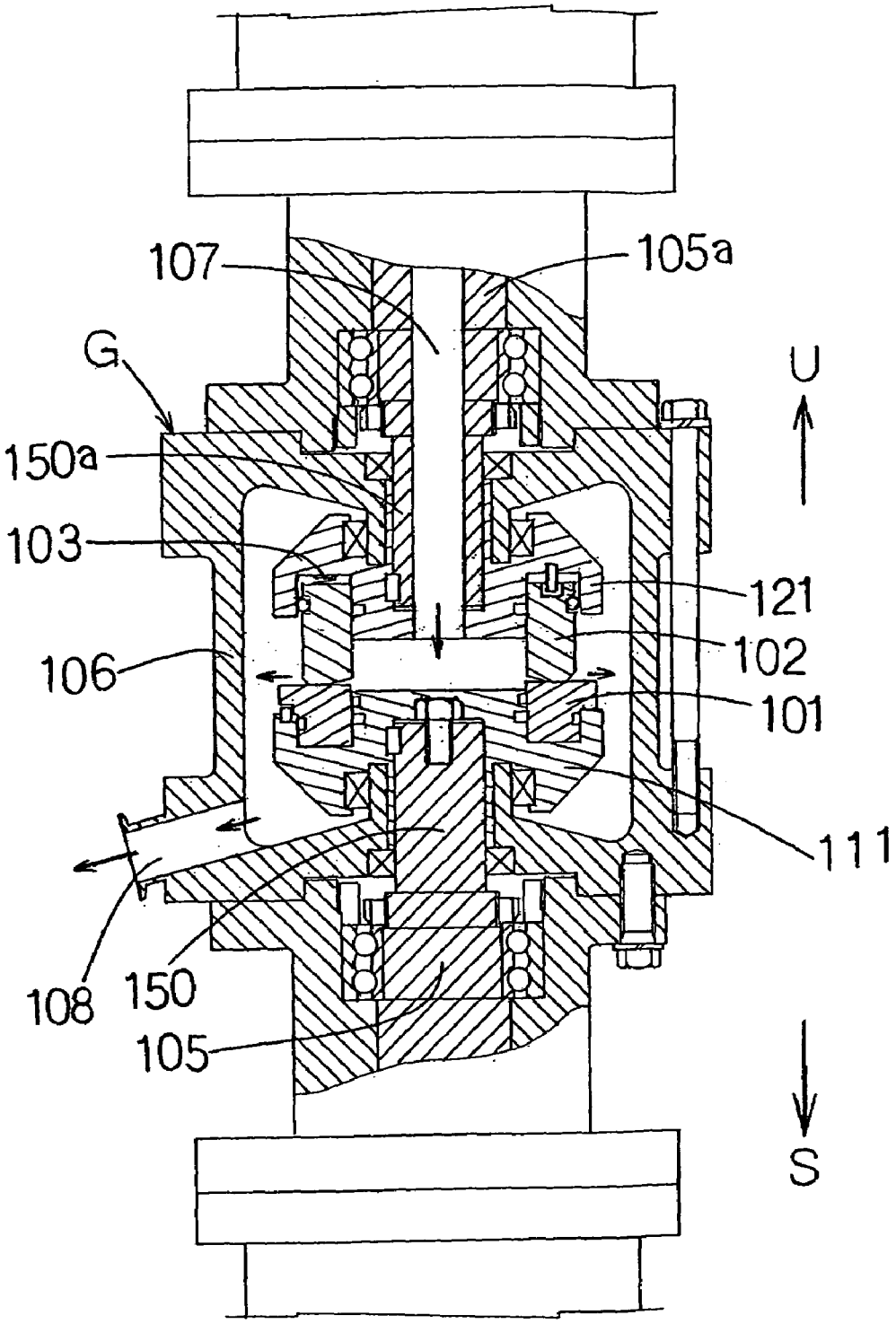
FIG. 17 is a partially cutaway longitudinal sectional view showing another embodiment of the deaerator, and FIGS. 18(A),(B),(C) are explanatory views of embodiments of separating methods for a substance without steam after atomization.
Figure 18A:
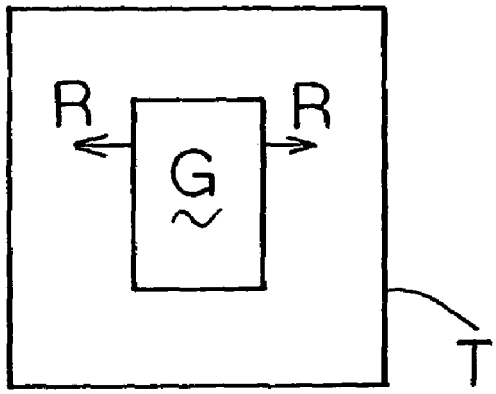
Figure 18B:
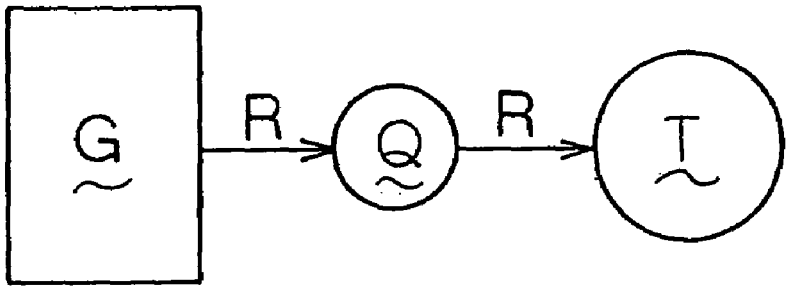
Figure 18C:
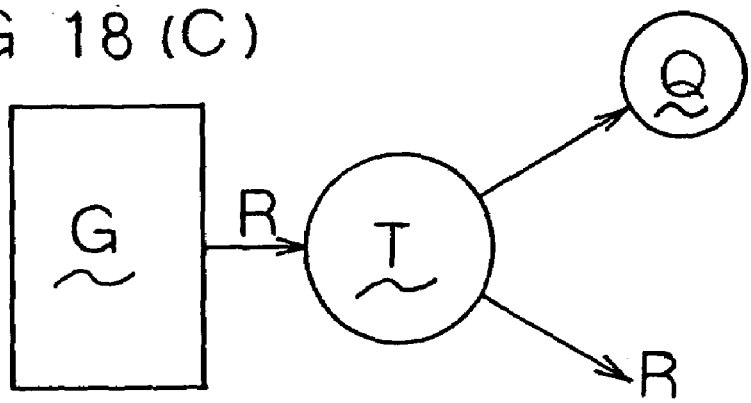

What is claimed is:

1. A processing apparatus for fluid comprising:

a feed for fluid to be processed;

a fluid pressure applying mechanism for applying predetermined pressure to fluid to be processed;

at least two processing faces comprising a first processing face and a second processing face, the first processing face having a first processing portion and the second processing face having a second processing portion, wherein at least one of the first or second processing faces is movable towards or away from the other, the first and second processing faces being connected with a tight-closed fluid passage through which the fluid flows, wherein the second processing face is formed on a lower surface of the a second processing portion, the second processing portion being an annular element;

a rotary drive mechanism for relatively rotating the first and second processing faces, thereby processing the fluid between both processing faces, the fluid being allowed to travel in use between the first and second processing faces, which relatively rotate, a fluid film with predetermined thickness being formed, whereby said fluid is processed to a desired condition of dispersion, emulsification, mixing, grinding, attrition, or atomization;

a face contact pressure applying mechanism for applying contact pressure between the two processing faces urging them into contact; and a pressure receiving surface on which said fluid under predetermined pressure acts in use to provide a separation force for separating the processing faces, wherein the fluid pressure applying mechanism, the face contact pressure and the pressure receiving surface are configured so that, in use, while the fluid is processed, the separation force between the processing surfaces is in balance with the contact pressure, the balance maintaining a predetermined interval between the processing faces in a microscale width.

2. A processing apparatus for fluid as defined in claim 1, wherein the second processing portion is disposed in an annular receiving portion of a holder.

3. A processing apparatus for fluid as defined in claim 1, wherein one or both of the first and second processing faces is provided with recesses.

4. A processing apparatus for fluid as defined in claim 1, wherein the first processing face and second processing face are disposed opposite to each other on respective said processing portions, the rotary drive mechanism is for relatively rotating the first and second processing portions, thereby processing the fluid between both processing faces, at least the second processing portion of the first and second processing portions is provided with the pressure receiving face, and at least one part of the pressure receiving face is constituted by the second processing face.

5. A processing apparatus for fluid as defined in claim 1, further comprising a buffer mechanism for adjusting vibration and alignment of at least one of the first and second processing faces.

6. A processing apparatus for fluid as defined in claim 4, further comprising a displacement adjusting mechanism for adjusting displacement of the shaft due to wear-out of one or both of the first and second processing faces to maintain the thickness of the fluid film formed therebetween.

7. A processing apparatus for fluid as defined in claim 4, further comprising a pressure adjusting mechanism for adjusting pressure applied to the fluid to be processed.

8. A processing apparatus for fluid as defined in claim 4, further comprising a separation control portion for defining the maximum interval between said first and second processing faces to prevent further separation thereof.

9. A processing apparatus for fluid as defined in claim 4, further comprising an access control portion for defining the minimum interval between the first and second processing faces to prevent further access thereof.

10. A processing apparatus for fluid as defined in claim 4, wherein both of the first and second processing faces are designed to rotate mutually in opposite directions.

11. A processing apparatus for fluid as defined in claim 4, further comprising a temperature control jacket for controlling the temperature of one or both of the first and second processing faces.

12. A processing apparatus for fluid as defined in claim 4, wherein at least a part of one or both of the first and second processing faces is subjected to planishing to form a mirror finish.

13. A processing apparatus for fluid as defined in claim 4, further comprising a different introduction passage independent of said fluid passage, wherein at least one of the first and second processing faces has an opening which admits to said introduction passage so as to enable introduction of a substance or another fluid to be processed from the introduction passage into the fluid being processed.

14. A processing apparatus for fluid, comprising:

a feed for fluid to be processed;

at least two processing members comprising a first processing face and a second processing face, which are placed opposite to each other and at least one of which is movable towards or away from the other, the first and second processing faces being connected with a tight-closed fluid passage through which the fluid flows; wherein the at least two processing members are disposed in an annular receiving portions of corresponding holders;

a rotary drive mechanism for relatively rotating at least one of the first and second processing members with respect to the other, wherein fluid is fed from the center portion of said rotary motion to the interval between said both processing members and then discharged outside thereof, and a fluid film with predetermined thickness is formed whereby said fluid is processed by dispersion, emulsification, mixing, grinding, attrition, or atomization;

a face contact applying mechanism for applying contact pressure between the two processing faces by biasing at least one of the processing members into contact with the other;

a dynamic pressure generating mechanism, said dynamic pressure generating mechanism being provided by both processing members interacting with the fluid traveling between them;

a pressure receiving surface, the dynamic pressure acting on said pressure receiving surface in use to provide a separation force for separating the processing members, wherein the dynamic pressure generating mechanism, the face contact pressure applying mechanism and the pressure receiving surface are configured so that, in use, the separation force between the processing members is in balance with the contact pressure, the balance maintaining a predetermined interval between the processing faces in a microscale width.

15. A processing apparatus for fluid as defined in claim 14, wherein said processing members include planished flat portions, one of the processing members having grooves formed on the flat portion, each of said grooves stretching outward from the center of the processing member, and having a flow limiting portion for limiting the flow traveling outward from the center of the processing member after it has passed through said groove.

16. A processing apparatus for fluid as defined in claim 15, wherein said flow limiting portion is formed to generally decrease the sectional area of the groove from the inner part thereof toward the periphery of the processing member.

17. A processing apparatus for fluid as defined in claim 14, wherein at least one of said first and second processing members is provided with a floating mechanism, which enables both processing members to access to or separate from each other, while an eccentric behavior of at least one of both processing members arising from the rotary motion may be absorbed by the other.

18. A processing apparatus for fluid as defined above in claim 14, wherein a floating mechanism is arranged so as to enable said first and second processing members to move towards or away from each other and to change the inclinations of the rotary shafts of both processing members.

19. A processing apparatus for fluid as defined in claim 14, wherein the at least two processing members are annular elements having common axes, and one of the processing moving along the common axes so that the first processing face moves toward or away from the second processing face.

20. A processing apparatus for fluid, comprising:

a feed for fluid to be processed;

at least two processing members comprising a first processing face and a second processing face, which are placed opposite to each other and at least one of which is movable towards or away from the other, the first and second processing faces being connected with a tight-closed fluid passage through which the fluid flows;

a rotary drive mechanism for relatively rotating at least one of the first and second processing members with respect to the other, wherein fluid is fed from the center portion of said rotary motion to the interval between said both processing members and then discharged outside thereof, and a fluid film with predetermined thickness is formed whereby said fluid is processed by dispersion, emulsification, mixing, grinding, attrition, or atomization;

a face contact applying mechanism for applying contact pressure between the two processing faces by biasing at least one of the processing members into contact with the other;

a dynamic pressure generating mechanism, said dynamic pressure generating mechanism being provided by both processing members interacting with the fluid traveling between them;

a pressure receiving surface, the dynamic pressure acting on said pressure receiving surface in use to provide a separation force for separating the processing members, wherein the dynamic pressure generating mechanism, the face contact pressure applying mechanism and the pressure receiving surface are configured so that, in use, the separation force between the processing members is in balance with the contact pressure, the balance maintaining a predetermined interval between the processing faces in a microscale width, and wherein said processing members include planished flat portions, one of the processing members having grooves formed on the flat portion, each of said grooves stretching outward from the center of the processing member, and having a flow limiting portion for limiting the flow traveling outward from the center of the processing member after it has passed through said groove.

* * * * *